US009359762B2

(12) United States Patent
Nichols et al.

(10) Patent No.: US 9,359,762 B2
(45) Date of Patent: Jun. 7, 2016

(54) BUILDING PRODUCT AND METHOD OF MANUFACTURE AND USE

(71) Applicant: Eovations, LLC, Grand Rapids, MI (US)

(72) Inventors: Kevin L. Nichols, Freeland, MI (US); Claude Brown, Jr., Saginaw, MI (US); Brett M. Birchmeier, Midland, MI (US); Bruce A. Malone, Midland, MI (US)

(73) Assignee: Eovations, LLC, Grand Rapids, MI (US)

( * ) Notice: Subject to any disclaimer, the term of this patent is extended or adjusted under 35 U.S.C. 154(b) by 0 days.

(21) Appl. No.: 14/212,110

(22) Filed: Mar. 14, 2014

(65) Prior Publication Data

US 2014/0272303 A1 Sep. 18, 2014

Related U.S. Application Data

(60) Provisional application No. 61/787,964, filed on Mar. 15, 2013.

(51) Int. Cl.
*E04C 2/20* (2006.01)

(52) U.S. Cl.
CPC ..... *E04C 2/205* (2013.01); *Y10T 428/24438* (2015.01)

(58) Field of Classification Search
CPC ..... E04C 2/205; Y10T 428/24438
USPC ..... 428/141, 143, 151; 264/157, 160
See application file for complete search history.

(56) References Cited

U.S. PATENT DOCUMENTS

| | | | | |
|---|---|---|---|---|
| 4,207,936 | A * | 6/1980 | Arbour | 144/360 |
| 6,479,128 | B1 | 11/2002 | Schafernak et al. | |
| 2005/0171246 | A1* | 8/2005 | Maine et al. | 524/13 |
| 2009/0098332 | A1* | 4/2009 | Han et al. | 428/114 |
| 2011/0018162 | A1* | 1/2011 | O'Brien et al. | 264/176.1 |
| 2012/0100355 | A1 | 4/2012 | Phan et al. | |
| 2012/0277336 | A1 | 11/2012 | Nichols et al. | |

FOREIGN PATENT DOCUMENTS

| | | | |
|---|---|---|---|
| JP | 09505247 | A | 5/1997 |
| KR | 1020070056010 | A | 5/2007 |

* cited by examiner

*Primary Examiner* — Nathan Van Sell
(74) *Attorney, Agent, or Firm* — McGarry Bair PC

(57) ABSTRACT

A building product and method for manufacturing a building product made from an oriented polymer composition which can be split to provide a surface of the building product with a plurality of visible fibrils to form an aesthetic representative of split wood.

25 Claims, 20 Drawing Sheets

BUILDING PRODUCT AND METHOD OF MANUFACTURE AND USE

CROSS-REFERENCE TO RELATED APPLICATIONS

This application claims the benefit of U.S. Provisional Patent Application No. 61/787,964, filed Mar. 15, 2013, which is incorporated herein by reference in its entirety.

TECHNICAL FIELD

The embodiments of the invention relate generally to building products and more particularly to roof and wall covering articles.

BACKGROUND

Natural wood shakes are a common siding and roofing product in the building market. This structural wood cladding is made from thin, narrow strips of wood, typically 0.125"-0.5" (0.32 cm to 1.27 cm) thick at the thickest point, 4" to 8" (10.2 cm to 20.3 cm) wide and 12" to 48" (30.5 cm to 121.9 cm) long, which may or may not be tapered in thickness, and which form an overlapping structure on either a roof or wall in order to prevent moisture infiltration into the structure. Many consumers find wood shakes to be highly desirable from an aesthetic standpoint, but often select alternative sheathing products (e.g., asphalt shingles, steel roofing and siding, vinyl lap siding, or molded plastic or press-formed cementitious sheathing products) due to their lower initial cost and perceived longevity when compared to wood shakes. In addition to their relative high cost, wood shakes are prone to splitting, mildewing and rotting over time as a result of being exposed to prolonged moisture (rain, snow, high humidity) and excessive or insufficient sun conditions. Cedar is commonly used for wood shakes because of its higher resistance to rotting, but all cellulosic-containing materials (wood) will eventually deteriorate in high moisture environments. Cedar is also a premium, expensive building material as a result of limited sources of supply.

A further inherent challenge with natural wood shakes is their tendency to break or separate along the grain when nails are driven through the shakes during installation or when impacted during installation or during their service life (foot traffic, falling tree branches, hail, ice, etc.) They tend to be particularly fragile in the lengthwise direction due to the natural grain of the wood and the relatively low crack propagation resistance of the material. As a result, wood shakes cannot be significantly bent, impacted or nailed close to an end grain edge without expected crack propagation and possible separation of the material over some or all of its length. Pre-drilling nail holes can help minimize separation from nailing, but further adds to the cost as an extra step in the installation process. Thus it would be desirable to have a synthetic product that mimics the desirable aesthetics of wood shakes, but avoids or minimizes the issues with wood just described.

Known commercial synthetic products made to mimic wood shakes are made from injection molded plastic or cementitious materials and have had reasonable market success, but are also costly and still lack the authenticity of real wood shakes because they cannot match the true texture and rustic split-wood appearance that consumers associate with real split-wood shakes. Such molded and pressed products are substantially free of surface imperfections like fibrils or "tear-outs", and as a result such molded and pressed products also lack the true random split grain texture that is inherent to real wood shingles which arises during a splitting operation from the nature of their wood grain which is not straight and typically comprises rings of varying density depending on growing season.

BRIEF SUMMARY

According to an embodiment of the invention, a building product comprising a body having a length and width both greater than a thickness thereof, the body having a first outer surface bordered by the body length and width, and having a first surface area, and a second outer surface bordered by the body length and width, juxtaposed with the first outer surface thereof, and having a second surface area comprises an oriented polymer composition forming the body comprising long chain polymer strands that are aligned with the length of the body, and a plurality of the long chain polymer strands having terminal portions that extend from at least one of the first or second outer surfaces on substantially the entire first or second surface area to form oriented polymer composition fibrils thereon, wherein the oriented polymer composition fibrils extending from the at least one of the first or second outer surfaces provide an aesthetic representative of a real wood split surface.

Additional embodiments of the article include one or more of the following: a split OPC article comprising polypropylene; a split OPC article having a density less than 1.0 g/cc and greater than 0.5 g/cc; a split OPC article having a density corrected flexural modulus greater than 2.4 GPa; a split OPC article comprising additives and/or fillers wherein additives may include UV stabilizers, fire retardant additives, colorants or foaming agents sufficient to provide a desired density, and a preferred filler is selected from talc or calcium carbonate. The oriented polymer composition can be a cavitated oriented polymer composition. In further embodiments, the oriented polymer composition further comprises a foaming agent. The oriented polymer composition can comprise long chain polymer strands having a predetermined degree of orientation such that when the body is split along its length to form at least one of the first or second outer surfaces, the long chain polymer strands are one of cut by the splitting to form the plurality of oriented polymer composition fibrils or lifted off the at least one of the first or second outer surface.

In another embodiment, a method for manufacturing a building product comprises the steps of providing a polymer composition having a softening temperature, drawing the polymer composition through a drawing die at a drawing temperature less than the softening temperature of the polymer composition, the polymer composition exiting the drawing die in an axial, lengthwise orientation, to form an oriented polymer composition comprising long chain polymer strands that are aligned lengthwise with the drawn oriented polymer composition, moving the oriented polymer composition against a splitting assembly to separate the oriented polymer composition lengthwise along a longitudinal axis of the oriented polymer composition into at least two planar portions, each planar portion comprising a split face where the oriented polymer composition is split, and splitting a plurality of the long chain polymer strands to form a plurality of long chain polymer strands having terminal portions that extend from the split face of each planar portion on substantially the entire split face of each planar portion to form oriented polymer composition fibrils thereon, wherein fibrils oriented polymer composition fibrils extending from the split face of each planar portion provide an aesthetic representative of a real wood split surface.

Other embodiments of the process are selected from one or more of the following: a continuous process; a semi-continuous process wherein the OPC article work piece is made by a continuous process as is known in the art, but the splitting is accomplished on cut board sections of a desirable length; the process further comprising cooling the drawn oriented polymer composition to a splitting temperature less than a softening temperature of the oriented polymer composition; a process wherein the splitting temperature is at least 10° C. below the drawing temperature of the OPC work piece; a process wherein the OPC work piece comprises additives, such as fire retardants, a filler selected from talc, magnesium hydroxide or calcium carbonate; a process in which the OPC article work piece density is less than 1.0 g/cc and greater than 0.5 g/cc and where the density corrected flexural modulus of the work piece is greater than 2.4 GPa; further comprising a locating device adapted to alter at least one of the position of the oriented polymer composition with respect to the splitting assembly, the impingement angle of the oriented polymer composition with respect to the splitting assembly, or both; further comprising the step of one of at least partially compounding or pre-compounding a volume of inorganic filler with the polymer composition; further comprising the step of forming a plurality of concentrated filler volumes within the oriented polymer composition to form crack propagation sites within the oriented polymer composition; the process wherein the step of drawing the oriented polymer composition through the drawing die is at a linear draw ratio greater than 4; further comprising separating the drawn oriented polymer composition into discrete portions prior to the step of splitting; wherein the splitting temperature is at least 25° C. below the softening temperature of the oriented polymer composition; and wherein the splitting further comprises lifting a plurality of the long chain polymer strands from the split face of each planar portion.

Apparatus for making such a split polymer product includes an alignment means for aligning a filled oriented polymer composition board (work piece) to a splitting wedge and at least one forwarding means adjacent the wedge for feeding a work piece into engagement with the leading edge(s) of at least one splitting wedge to divide the work piece into at least two sections along its length in a direction coinciding with the alignment of the long chain polymer strands of the oriented polymer composite material. In a preferred embodiment, there is a forwarding means both before and after the splitting station where the forwarding means upstream of the splitting station provides the motive force for the work piece when starting up the operation and the forwarding means downstream of the splitting station provides motive force for the work piece during continuous operation and forwards the split work piece sections together in a combined board wherein the split faces are proximate to one another. In further embodiments, the splitting assembly includes a wedge. The wedge can be provided with a predetermined wedge angle to alter at least one characteristic of the fibrils formed on the surface of the oriented polymer composition during the splitting step. A wedge angle of the wedge is can be 70 degrees or less and greater than 20 degrees

BRIEF DESCRIPTION OF THE DRAWINGS

In the drawings.

These and other features and advantages of the present invention will become better understood to those of ordinary skill in the art when considered in connection with the following description and drawings.

DESCRIPTION OF EMBODIMENTS OF THE INVENTION

Terms

Figure 1A:
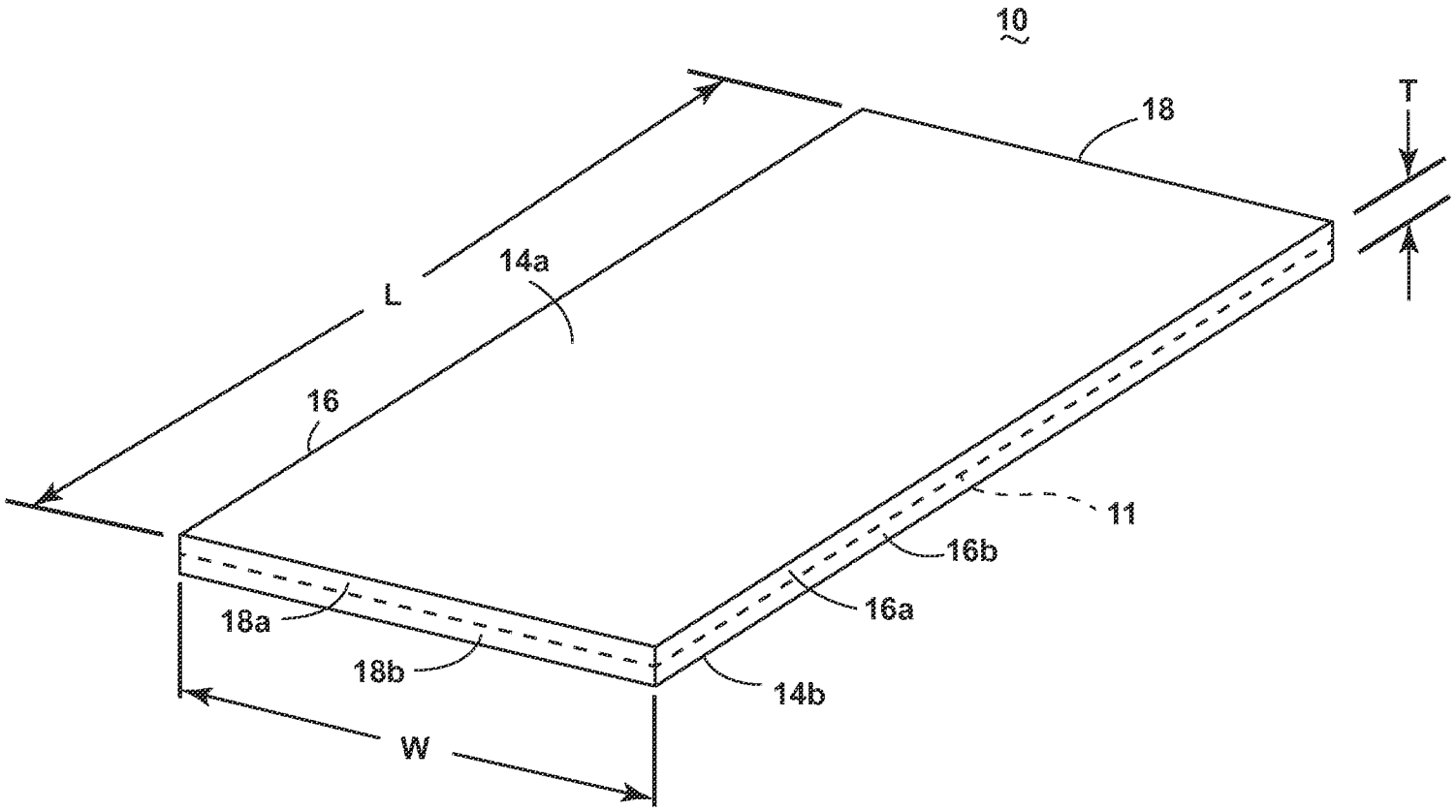
FIGS. 1A and 1B illustrate a building product according to an embodiment of the invention.

"Solid state" refers to a polymer (or polymer composition) that is below the softening temperature of the polymer (or polymer composition). Hence, "solid state drawing" refers to drawing a polymer or polymer composition that is below the softening temperature of the polymer (or polymer composition). "Solid state die drawing" refers to drawing a polymer or polymer composition that is below its softening temperature through a shaping die.

"Polymer composition" comprises at least one polymer component and can contain non-polymeric components. A "filled" polymer composition includes discontinuous additives, such as inorganic or organic fillers.

An "orientable polymer" is a polymer that can undergo induced molecular orientation by solid state deformation (for example, solid state drawing). An orientable polymer can be amorphous or semi-crystalline (semi-crystalline polymers have a melt temperature (Tm) and include those polymers known as "crystalline"). Desirable orientable polymers include semi-crystalline polymers, and in particular linear polymers (polymers in which chain branching occurs in less than 1 of 1,000 polymer units). Semi-crystalline polymers can be particularly desirable because they can result in greater increase in strength and modulus than amorphous polymer compositions. Semi-crystalline polymer compositions can result in 4-10 times greater increase in strength and flexural modulus upon orientation over amorphous polymer compositions.

An "orientable polymer phase" is a polymer phase that can undergo induced molecular orientation by solid state deformation (for example, solid state drawing). Typically, 75 weight-percent (wt %) or more, even 90 wt % or more or 95 wt % or more of the polymers in the orientable polymer phase are orientable polymers based on total orientable polymer phase weight. All of the polymers in an orientable polymer phase can be orientable polymers. An orientable polymer phase may comprise one or more than one type of polymer and one or more than one type of orientable polymer.

"Oriented polymer composition article", "OPC" and "oriented polymer composition" are interchangeable and refer to an article made by orienting the polymers of a polymer composition. An oriented polymer composition comprises polymer molecules that have a higher degree of molecular orientation than that of a polymer composition extruded from a mixer.

"Weight-percent" and "wt %" are interchangeable and are relative to total polymer weight unless otherwise stated.

"Softening temperature" (Ts) for a polymer or polymer composition having as polymer components only one or more than one semi-crystalline polymer is the melting temperature for the continuous phase polymer in the polymer composition.

"Melting temperature" (Tm) for a semi-crystalline polymer is the temperature half-way through a crystalline-to-melt phase change as determined by differential scanning calorimetry (DSC) upon heating a crystallized polymer at a specific heating rate. Tm for a semi-crystalline polymer can be determined according to the DSC procedure in ASTM method E794-06. Tm for a combination of polymers and for a filled polymer composition can also be determined by DSC under the same test conditions in ASTM method E794-06. If the combination of polymers or filled polymer composition only contains miscible polymers and only one crystalline-to-melt phase change is evident in the a DSC curve, then Tm for the polymer combination or filled polymer composition is the temperature half-way through the phase change. If multiple crystalline-to-melt phase changes are evident in a DSC curve due to the presence of immiscible polymers, then Tm for the polymer combination or filled polymer composition is the Tm of the continuous phase polymer. If more than one polymer is continuous and they are not miscible, then the Tm for the polymer combination or filled polymer composition is the highest Tm of the continuous phase polymers.

"Softening temperature" (Ts) for a polymer or polymer composition having as polymer components only one or more than one amorphous polymer is the glass transition temperature for the continuous phase of the polymer composition.

If the semi-crystalline and amorphous polymer phases are co-continuous, then the softening temperature of the combination is the lower softening temperature of the two phases. If the polymer composition contains a combination of semi-crystalline and amorphous polymers, the softening temperature of the polymer composition is the softening temperature of the continuous phase polymer of the polymer composition.

"Glass transition temperature" (Tg) for a polymer or polymer composition is the temperature half-way through a glass transition phase change as determined by DSC according to the procedure in ASTM method D3418-03. Tg for a combination of polymers and for a filled polymer composition can also be determined by DSC under the same test conditions in D3418-03. If the combination of polymer or filled polymer composition only contains miscible polymers and only one glass transition phase change is evident in the DSC curve, then Tg of the polymer combination or filled polymer composition is the temperature half-way through the phase change. If multiple glass transition phase changes are evident in a DSC curve due to the presence of immiscible amorphous polymers, then Tg for the polymer combination or filled polymer composition is the Tg of the continuous phase polymer. If more than one amorphous polymer is continuous and they are not miscible, then the Tg for the polymer composition or filled polymer composition is the highest Tg of the continuous phase polymers.

If the polymer composition contains a combination of semi-crystalline and amorphous polymers, the softening temperature of the polymer composition is the softening temperature of the continuous phase polymer or polymer composition.

"Drawing temperature" refers to the temperature of the polymer composition as it begins to undergo drawing in a solid state drawing die.

"Linear Draw Ratio" is a measure of how much a polymer composition elongates in a drawing direction (direction the composition is drawn) during a drawing process. Linear draw ratio can be determined while processing by marking two points on a polymer composition spaced apart by a pre-orientated composition spacing and measuring how far apart those two points are after drawing to get an oriented composition spacing. The ratio of final spacing to initial spacing identifies the linear draw ratio.

"Nominal draw ratio" is the cross sectional surface area of a polymer composition as it enters a drawing die divided by the polymer cross sectional area as it exits the drawing die.

"Splitting temperature" refers to the temperature of the oriented polymer composition article work piece, as it begins to undergo splitting, as it is drawn over a splitting wedge in a splitting process.

"Splitting rate" refers to the rate in units of length per unit time at which the work piece is drawn over a splitting wedge.

"Work Piece" is generally defined as material that is in the process of being worked on or made or has actually been cut or shaped by a hand tool or machine. For the purposes of this invention, "work piece" refers to an oriented polymer composition, particularly, an oriented polymer composition board after having exited the drawing die and prior to, during, or after its being fabricated or "worked" by being split by the splitting wedge of the process of the invention. The terms "work piece sections", "split work piece sections", "split OPC sections", and "split OPC board sections" are used interchangeably to refer to the components of the oriented polymer composition work piece after splitting.

A "tear-out" in a worked fibrous surface refers to fibers on the surface that are lifted by the wedge or plane of the tool, as opposed to being cut (sheared) off, resulting in a jagged finish.

Fibrils on a surface refers to visible strands, which may also be referred to as fibers, comprising bundles of aligned polymer strands that have been cut along at least a portion of their length and/or width to at least partially separate the strands from the surface.

An OPC is "similar" to another OPC if its composition is substantially the same as the other OPC in all respects except those noted in the context where the similar OPC is referenced. Compositions are substantially the same if they are the same within reasonable ranges of process reproducibility.

"ASTM" refers to ASTM International, formerly American Society for Testing and Materials; the year of the method is either designated by a hyphenated suffix in the method number or, in the absence of such a designation, is the most current year prior to the filing date of this application.

"Multiple" means at least two.

"And/or" means "and, or as an alternative."

Ranges include endpoints unless otherwise stated.

Temperatures are given in degrees Celsius, abbreviated as "C" unless otherwise noted.

Flexural modulus is measured according to ASTM D-6109-05.

Density is measured according to ASTM method D-792-00.

Figure 1B:
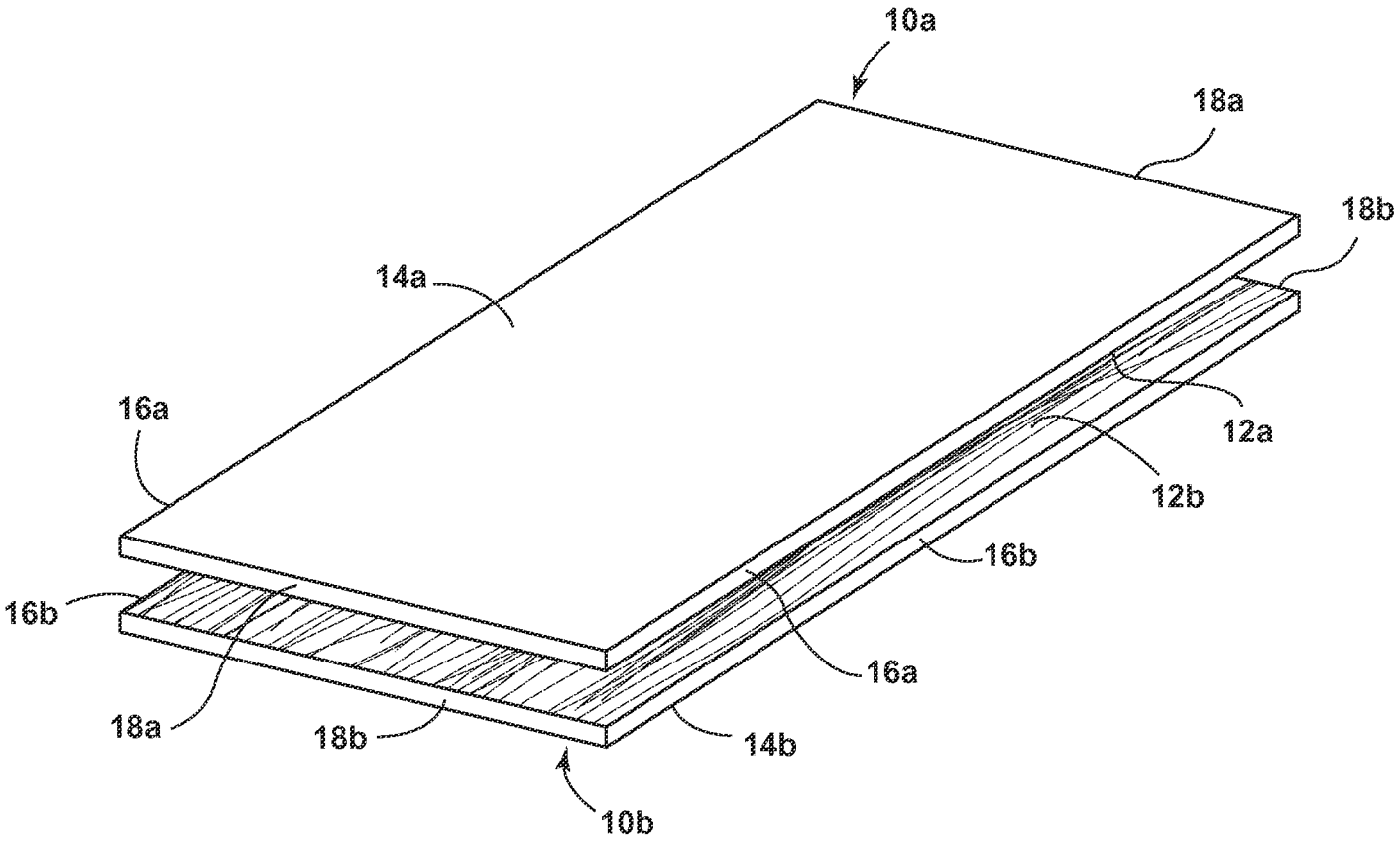
Figure 2A:
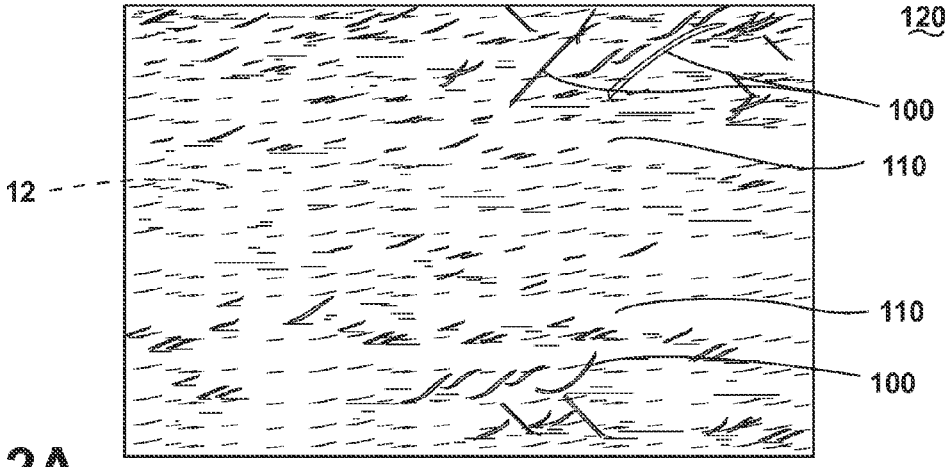
FIGS. 2A and 2B illustrate split surfaces of an oriented building product according to an embodiment of the invention.
Figure 2B:
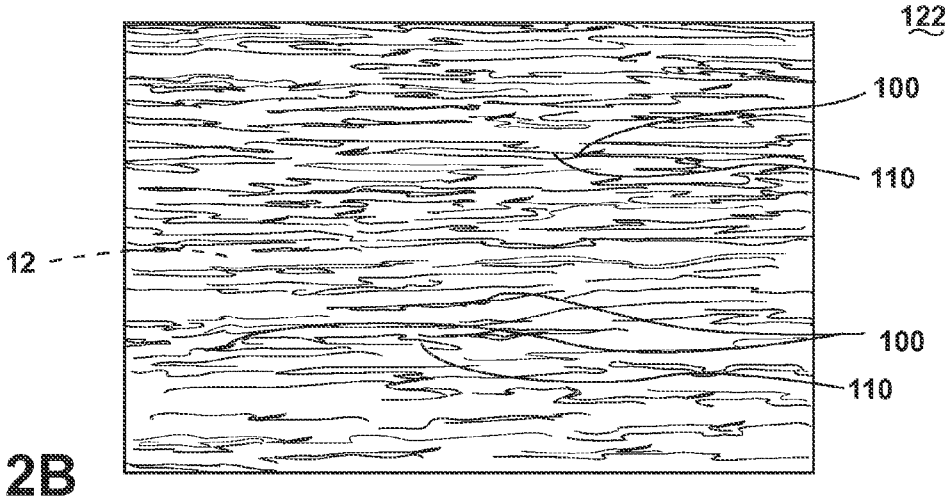
Figure 3:
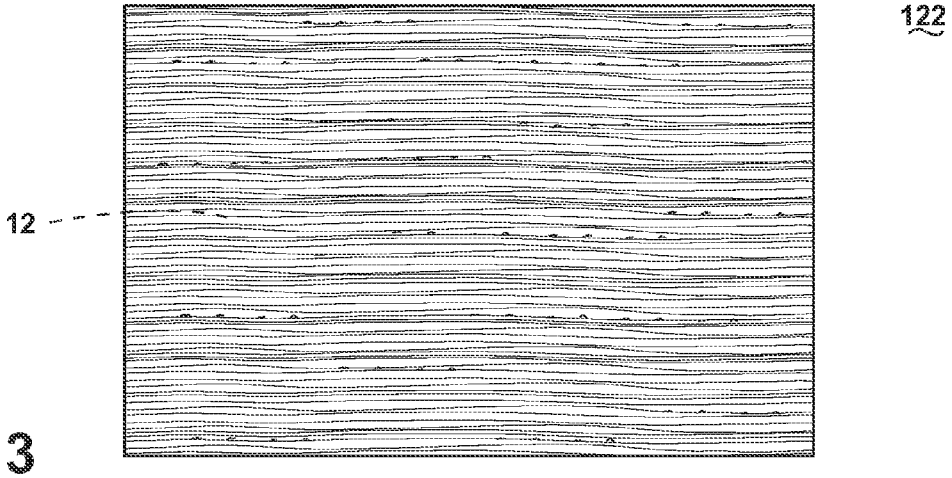
FIG. 3 illustrates the split surface of FIG. 2B that has been sanded, heat treated and brushed according to an embodiment of the invention.

FIGS. 1-3 illustrate a building product in the form of a board 10 for use in roofing and wall covering applications, such as simulated wood shakes. Referring to FIGS. 1A and 1B, the board 10 may be formed from an oriented polymer composition, such as a solid state die drawn long chain polymer composition (which can also be referred to as a composite, if a filler material is blended with the oriented polymer composition). A split surface 12*a, b* can be formed by mechanical rough splitting of the board 10, which will be described in greater detail below, to provide a decorative surface that simulates the three-dimensional rough-split texture and appearance of a standard wood shake.

Referring now to FIG. 1A, the board 10 can have a length L, a width W and a thickness T. The length dimension L is greater than the width dimension W, which in turn is greater than the thickness dimension T. The length L may be any suitable length but typically ranges from about 12 inches (30.5 cm) to 48 inches (121.9 cm) or more, the width W may range from about 2 inches (5.1 cm) to 12 inches (30.5 cm), and the thickness T may range from ⅛ inch (0.32 cm) to 2 inches (5.1 cm). The board 10 can be used to form shakes for roofing or siding applications, or boards or other sheathing products for roof and/or wall covering or trim applications. A particularly desirable application is that of shakes, where the board 10 may be used to form composite shakes that serve as a substitute for conventional real wood shakes, but do not have the same challenges with respect to rotting, warping, cracking, separating, splitting, insect damage and deterioration normally associated with wood shakes, while simulating the aesthetic look and split fibrous texture of real wood shakes.

Referring to FIGS. 1A and 1B, the board 10 can be defined by opposing top and bottom faces 14*a* and 14*b*, side faces 16*a* and 16*b* and end faces 18*a* and 18*b*. The board 10 can be split along a plane 11 extending longitudinally through an interior of the board 10 to form two boards 10*a* and 10*b*, each having a split surface 12*a*, 12*b* where the boards 10*a*, 10*b* were split. The remaining surfaces of the board 10*a*, the top face 14*a*, the side faces 16*a* and the end faces 18*a*, and the remaining surfaces of the board 10*b*, the top face 14*b*, the side faces 16*b* and the end faces 18*b* may be characteristically different and relatively smooth from either die drawing, sawing and/or sanding or other smoothing operations for example. Each board 10*a*, 10*b* may be additionally split to provide one or more of the faces 14*a*, 14*b*, 16*a*, 16*b*, and/or 18*a*, 18*b* with a fibrous split texture. The board 10 can be formed from a filled, oriented polymer composition (OPC) that comprises polymer molecules that have a higher degree of molecular orientation than that of a polymer composition extruded from a mixer.

Referring now to FIGS. 2A and 2B, a split portion 120 and 122 formed from splitting a board 10 made from a filled OPC with splitting wedges of 24 and 70 degree angles, respectively, is illustrated. The split surfaces 12 of the split portions 120 and 122 of FIGS. 2A and 2B show surface fibrils 100 and areas of "tear out" 110 that are present when a filled OPC board 10 is split with a wedge at different angles. Splitting with wedges at different angles can be used to provide different degrees of texture and roughness to the split surface 12. As can be seen in FIG. 2A, the smaller angle wedge produces finer surface fibrils than the larger angled wedge that produces coarser surface fibrils, as illustrated in FIG. 2B. FIG. 3 illustrates the split portion 122 of FIG. 2B after further surface treatment with sanding, heat treatment and brushing.

Figure 4A:
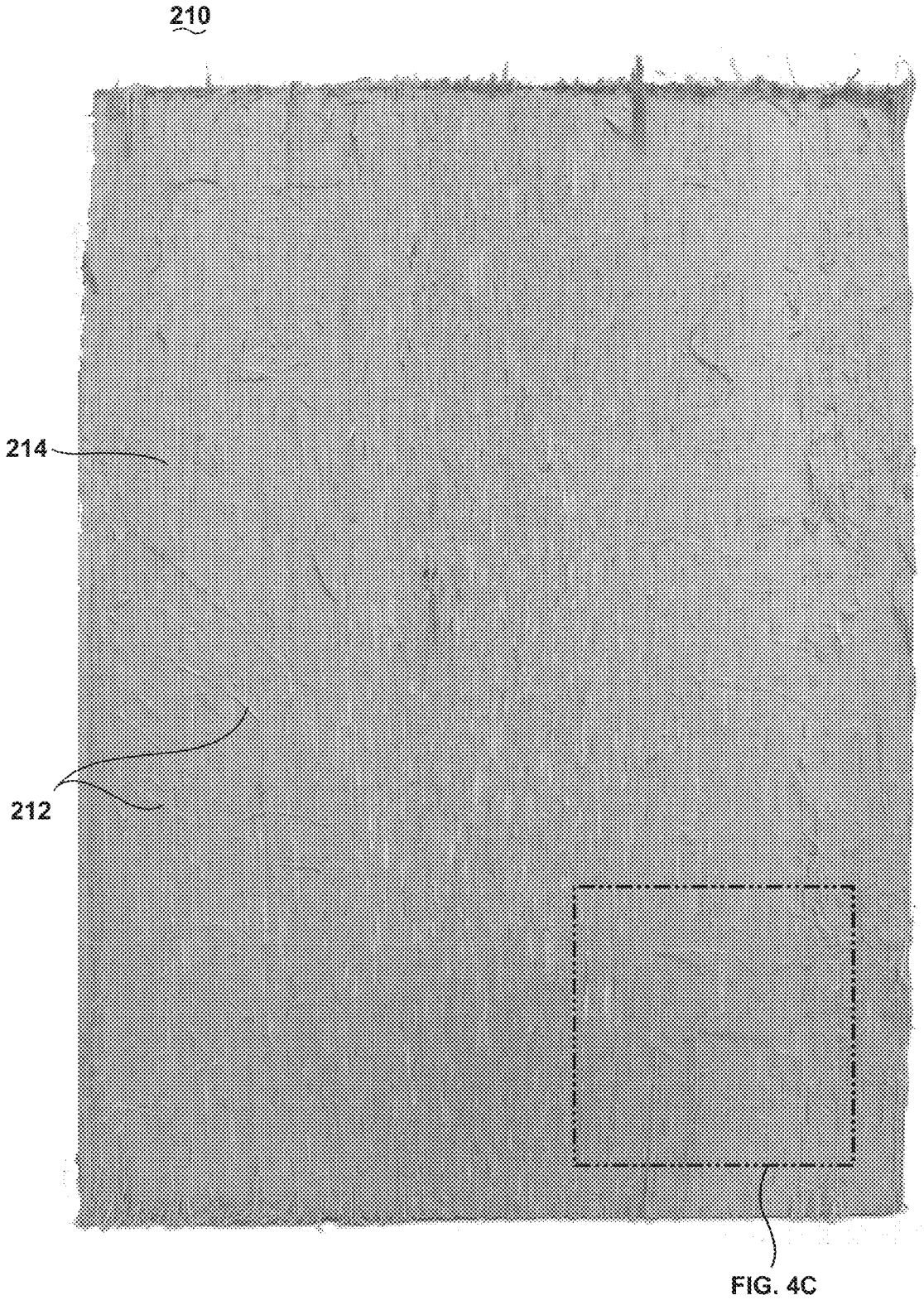
FIG. 4A is a photograph of a top-down view of a split surface of an oriented building product according to an embodiment of the invention.
Figure 4B:
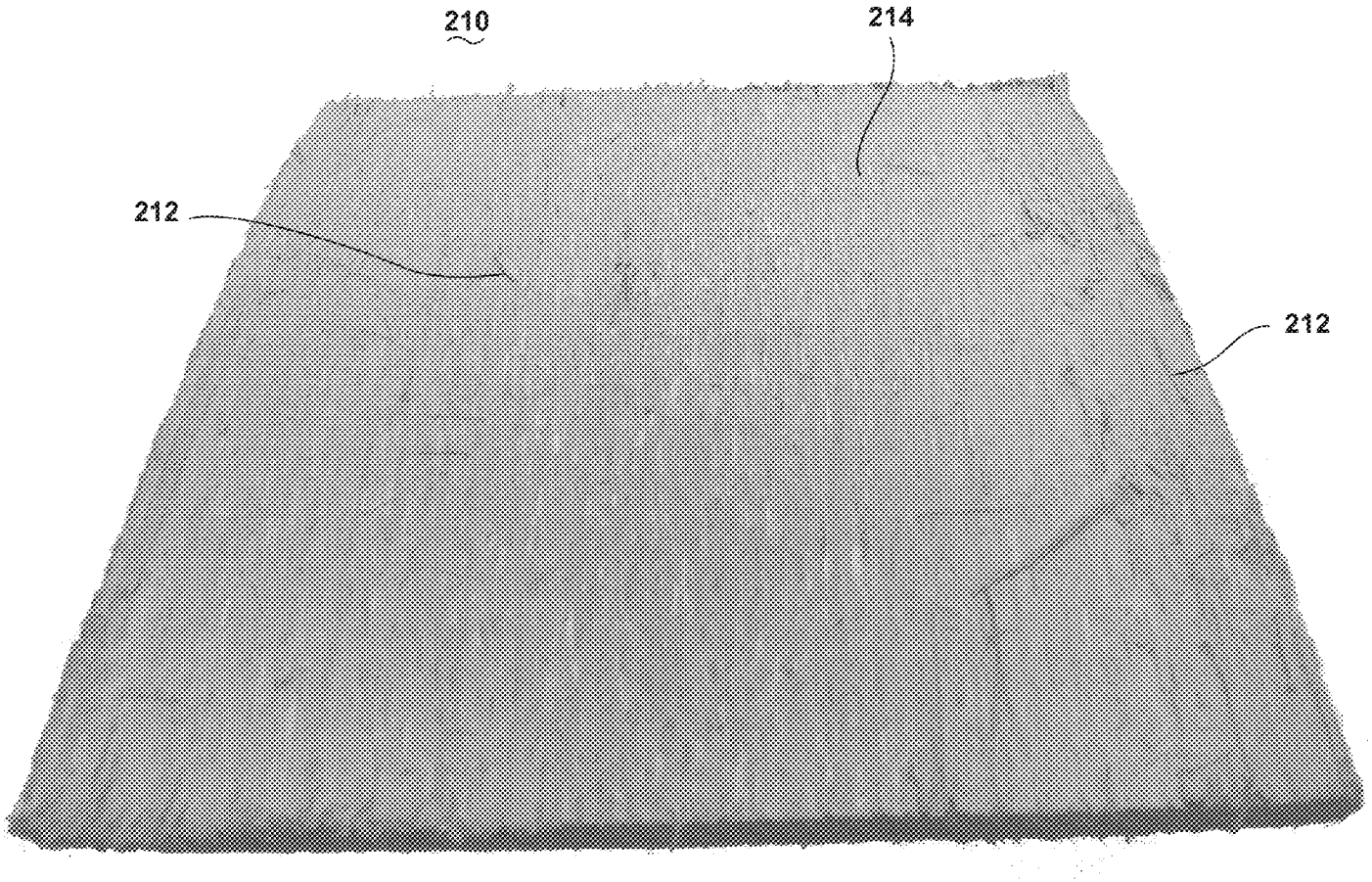
FIG. 4B is a photograph of a perspective view of the split surface of an oriented building product of FIG. 4A.
Figure 4C:
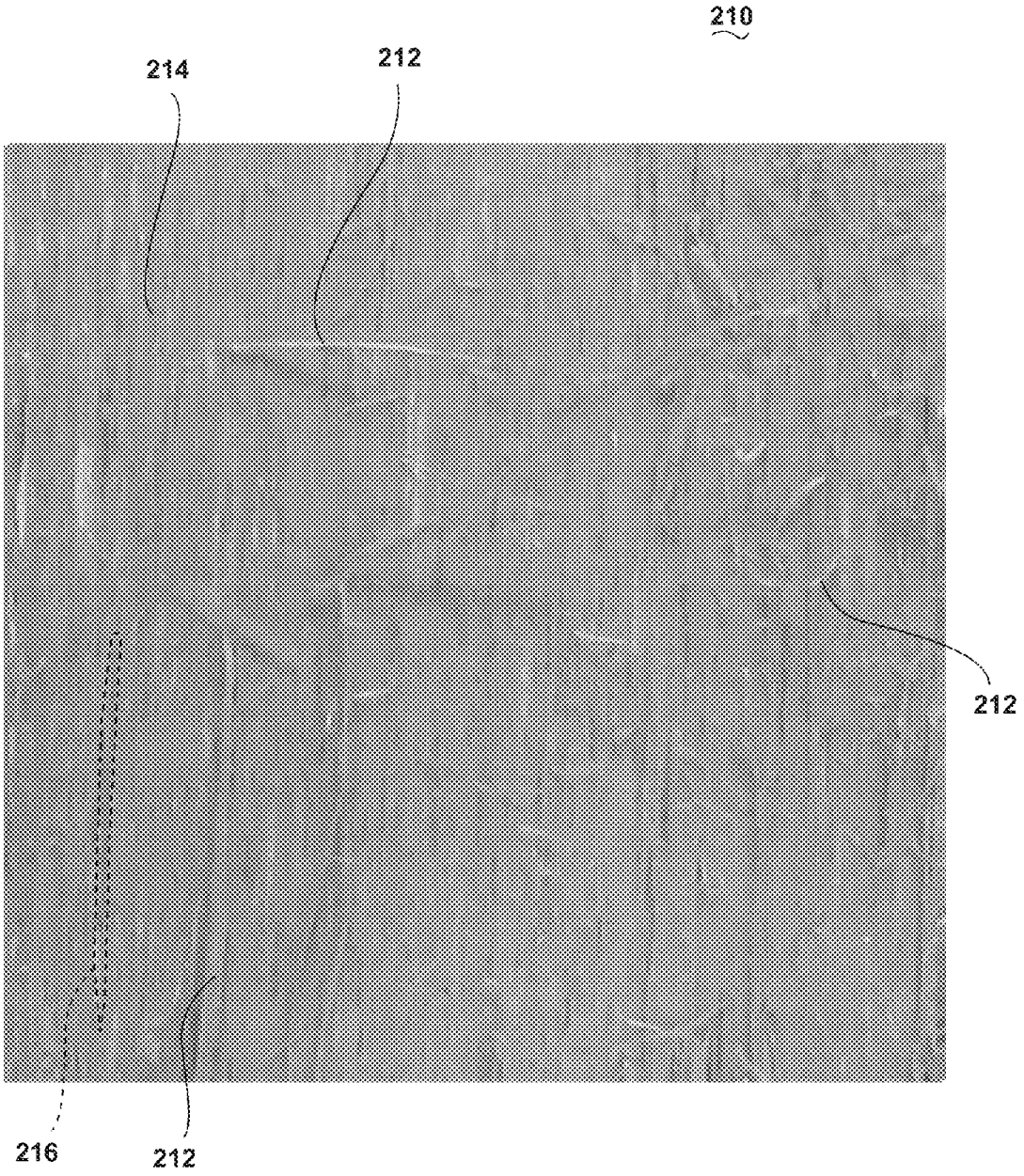
FIG. 4C is a photograph of the zoomed area indicated in FIG. 4A.
Figure 5A:
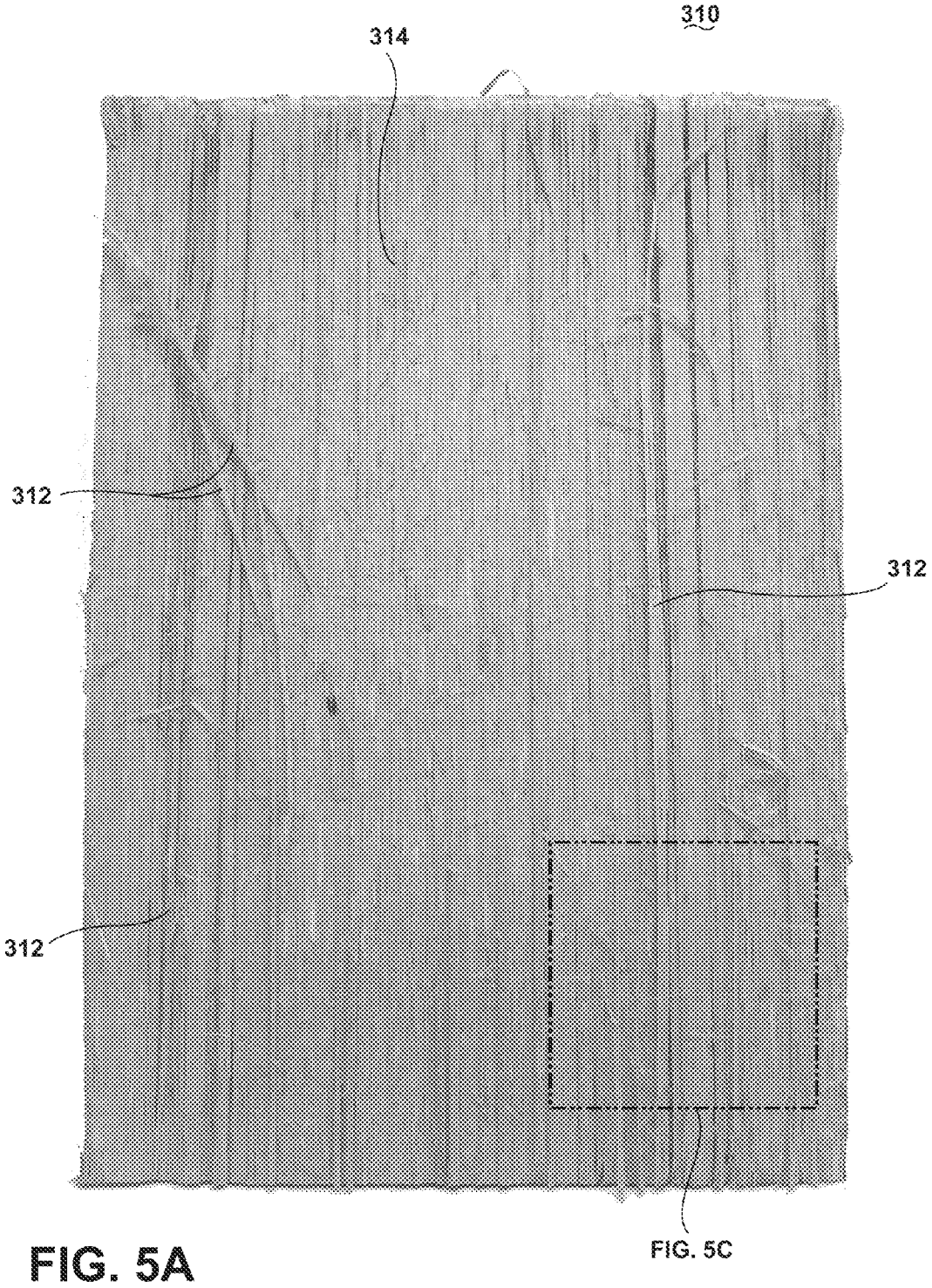
FIG. 5A is a photograph of a top-down view of a split surface of an oriented building product according to an embodiment of the invention.
Figure 5B:
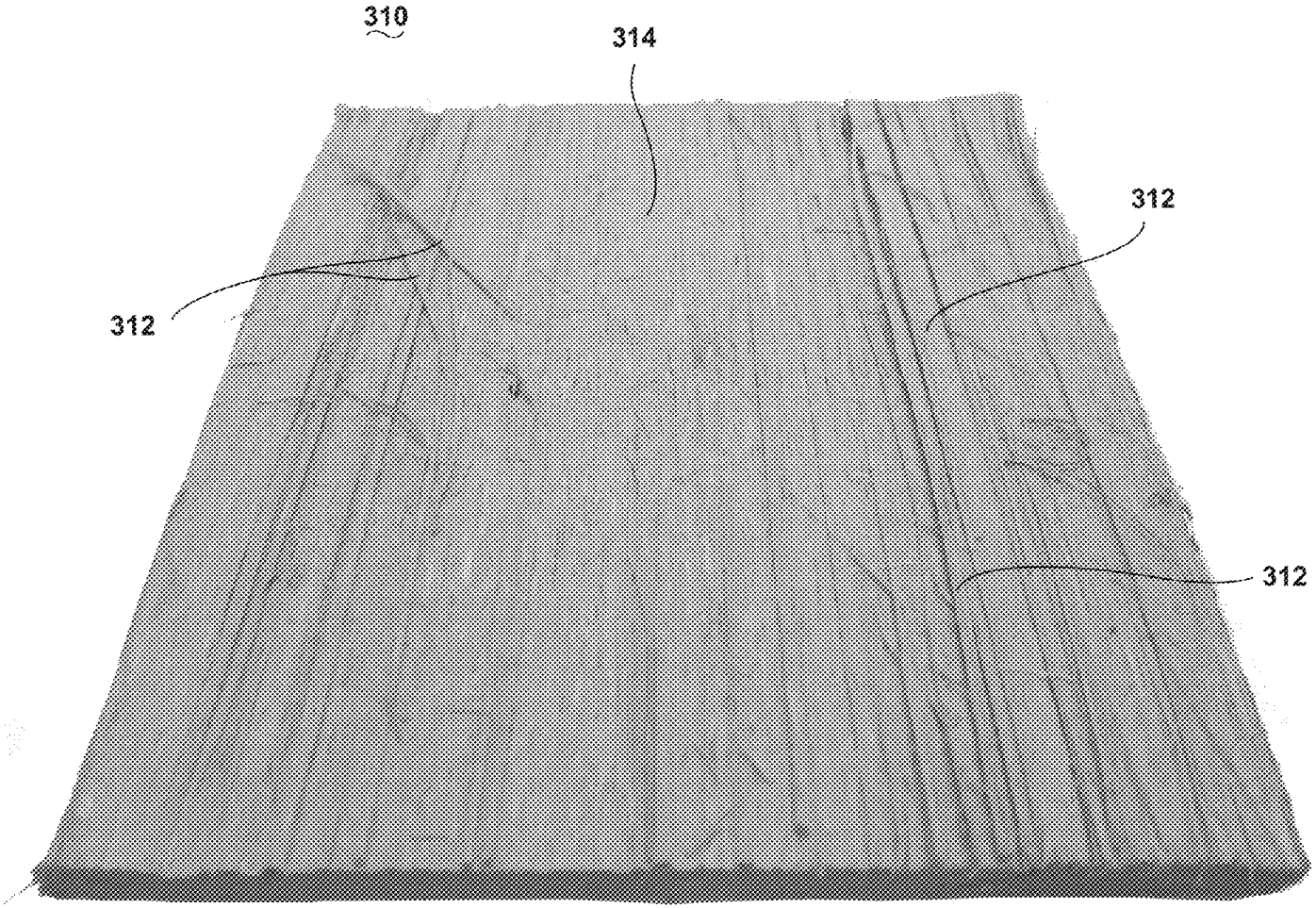
FIG. 5B is a photograph of a perspective view of the split surface of FIG. 5A.
Figure 5C:
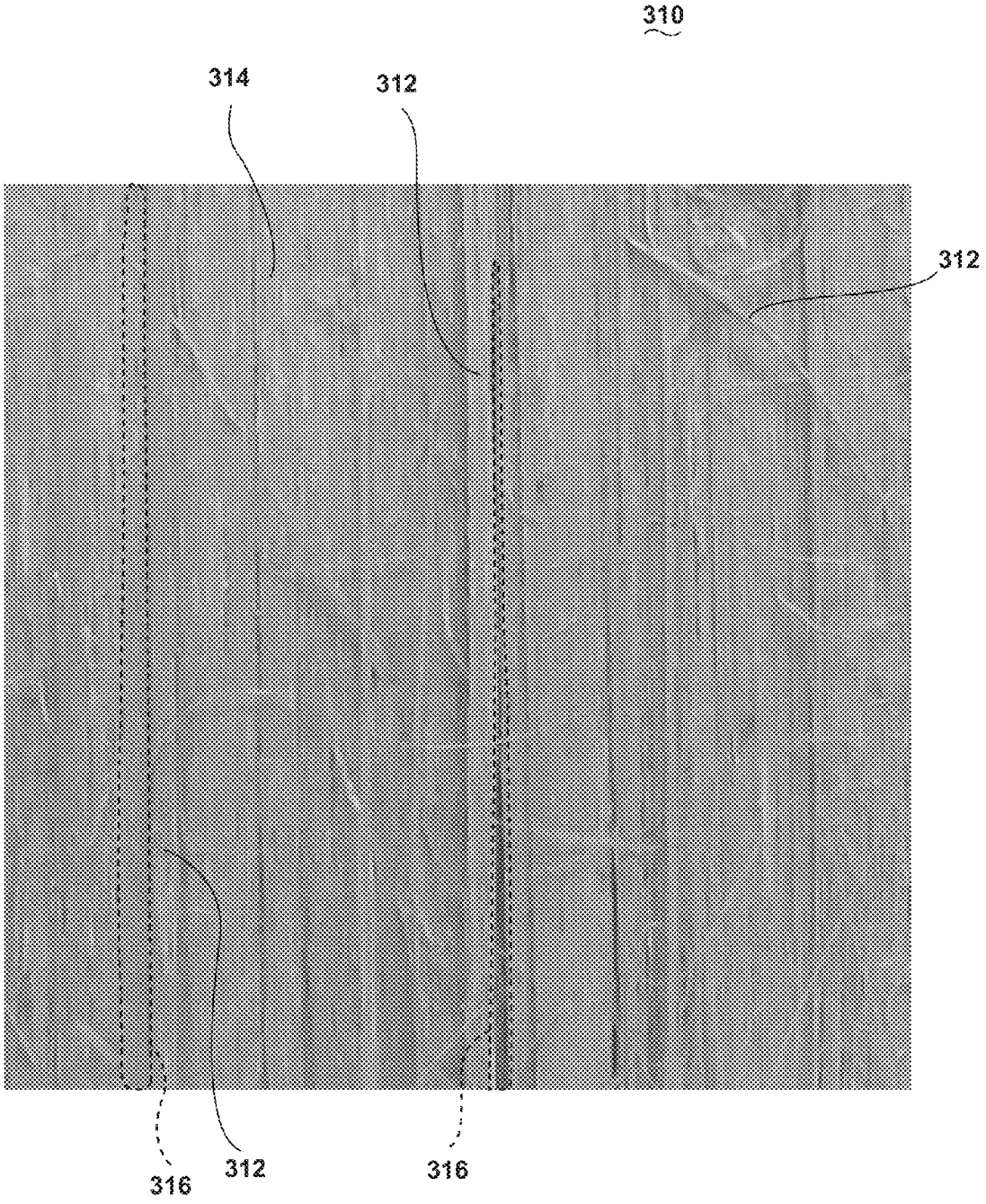
FIG. 5C is a photograph of the zoomed area indicated in FIG. 5A.

FIGS. 4A-C and 5A-C are photographs of exemplary boards 210 and 310 made from a die drawn, filled OPC material that have been split by a splitting wedge having a wedge angle of 24 and 70 degrees, respectively. The exemplary boards 210 and 310 were made by solid state die drawing Formulation B in Table 1 below, which includes polypropylene and a talc filler. As can be seen in FIGS. 4A-C, the 24 degree wedge angle produces random and non-uniform fibrils 212 extending from a split surface 214 along a length of the board 210 as well as areas of tear-out 216. Many of the fibrils 212 extend above a splitting plane which formed the split surface 214 with the areas of tear-out 216 extending below the splitting plane. Referring now to FIGS. 5A-C, the 70 degree wedge angle produces random and non-uniform fibrils 312 that are larger and less fine than those produced using the 24 degree wedge angle in a split surface 314 of the board 310. In addition, areas of tear-out 316 produced using the 70 degree wedge angle are typically larger in depth and/or length than those produced with the smaller 24 degree wedge angle.

Figure 6A:
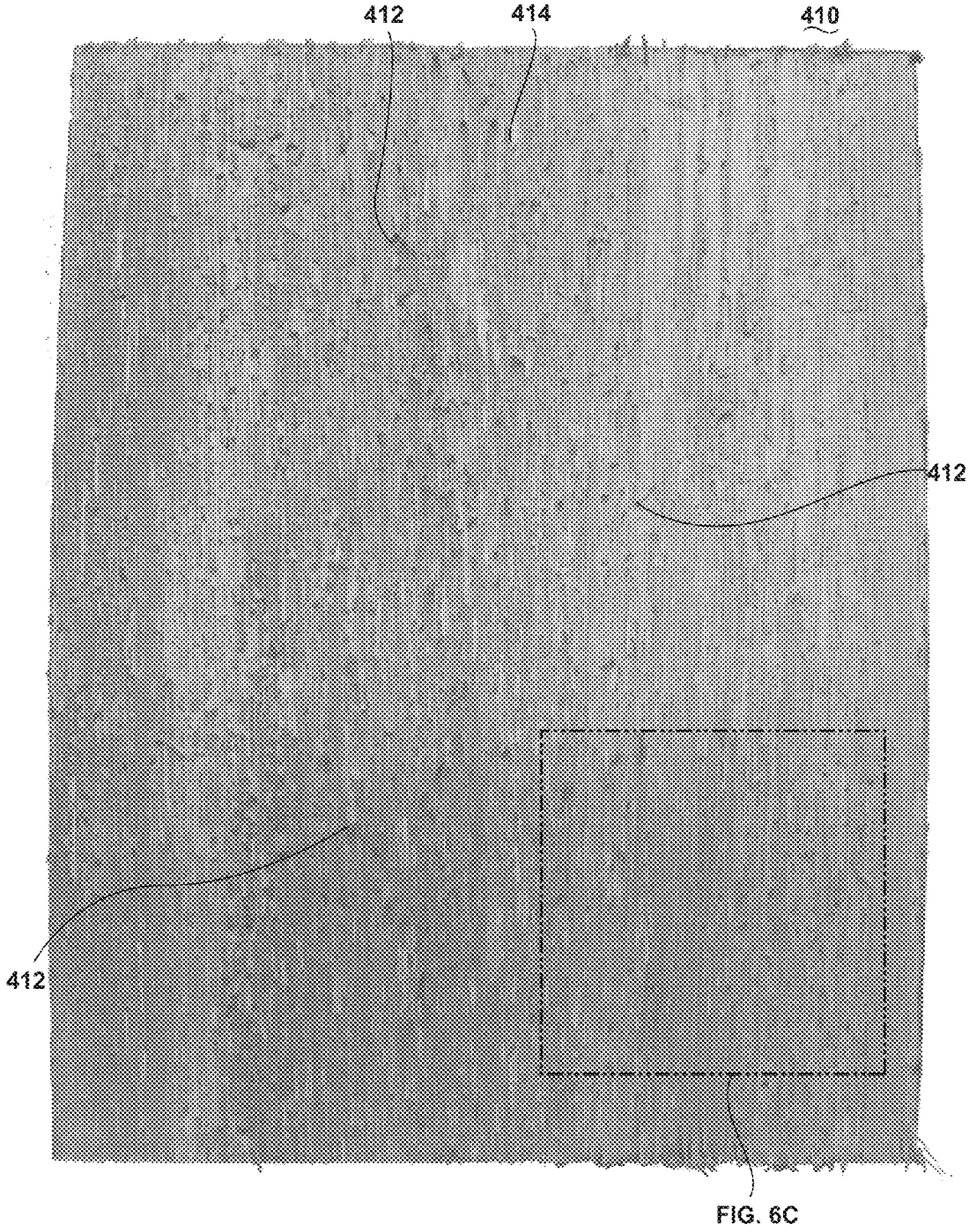
FIG. 6A is a photograph of a top-down view of a split surface of an oriented building product that has been sanded, heat treated and brushed according to an embodiment of the invention.
Figure 6B:
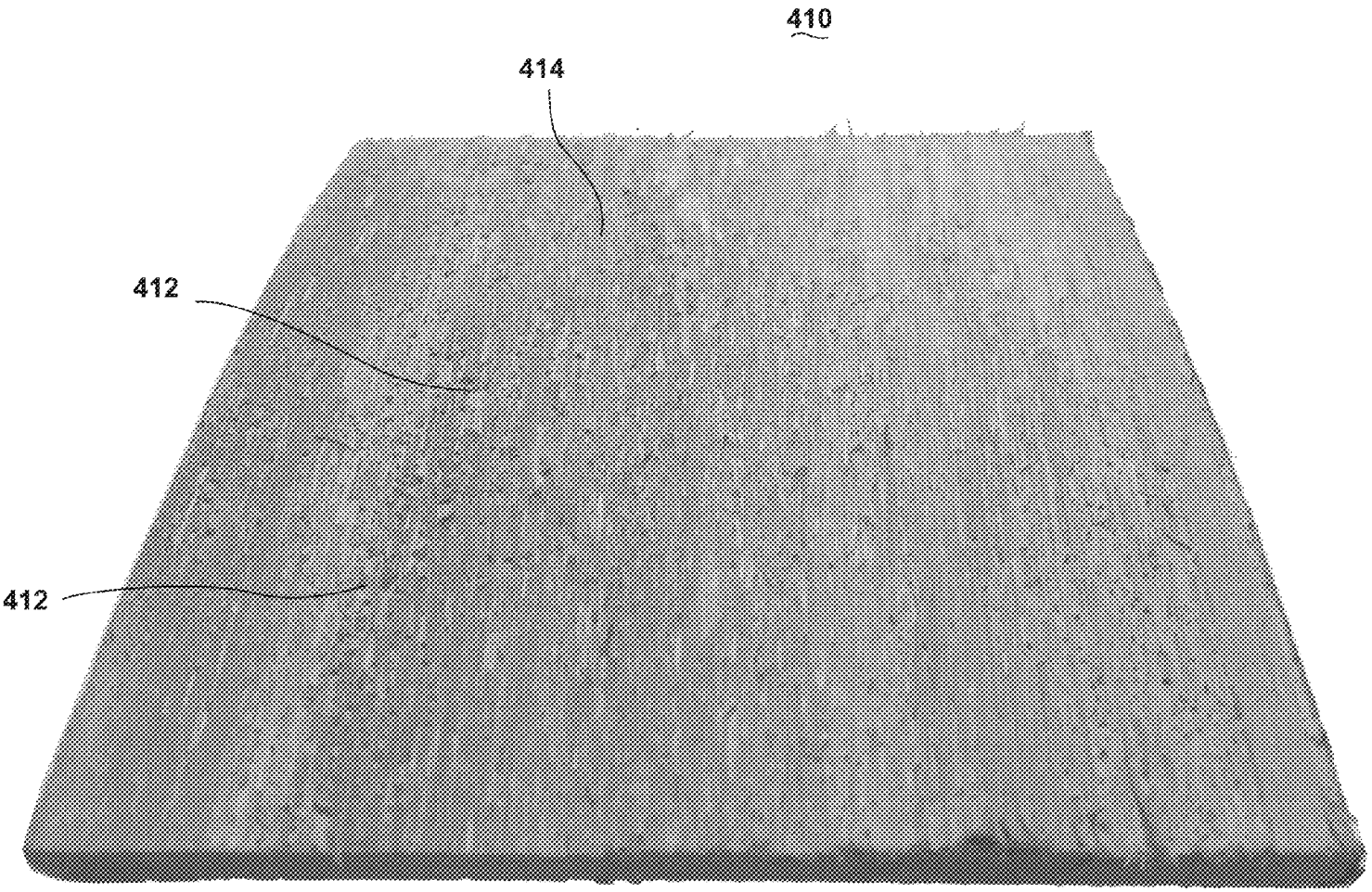
FIG. 6B is a photograph of a perspective view of the split surface of FIG. 6A.
Figure 6C:
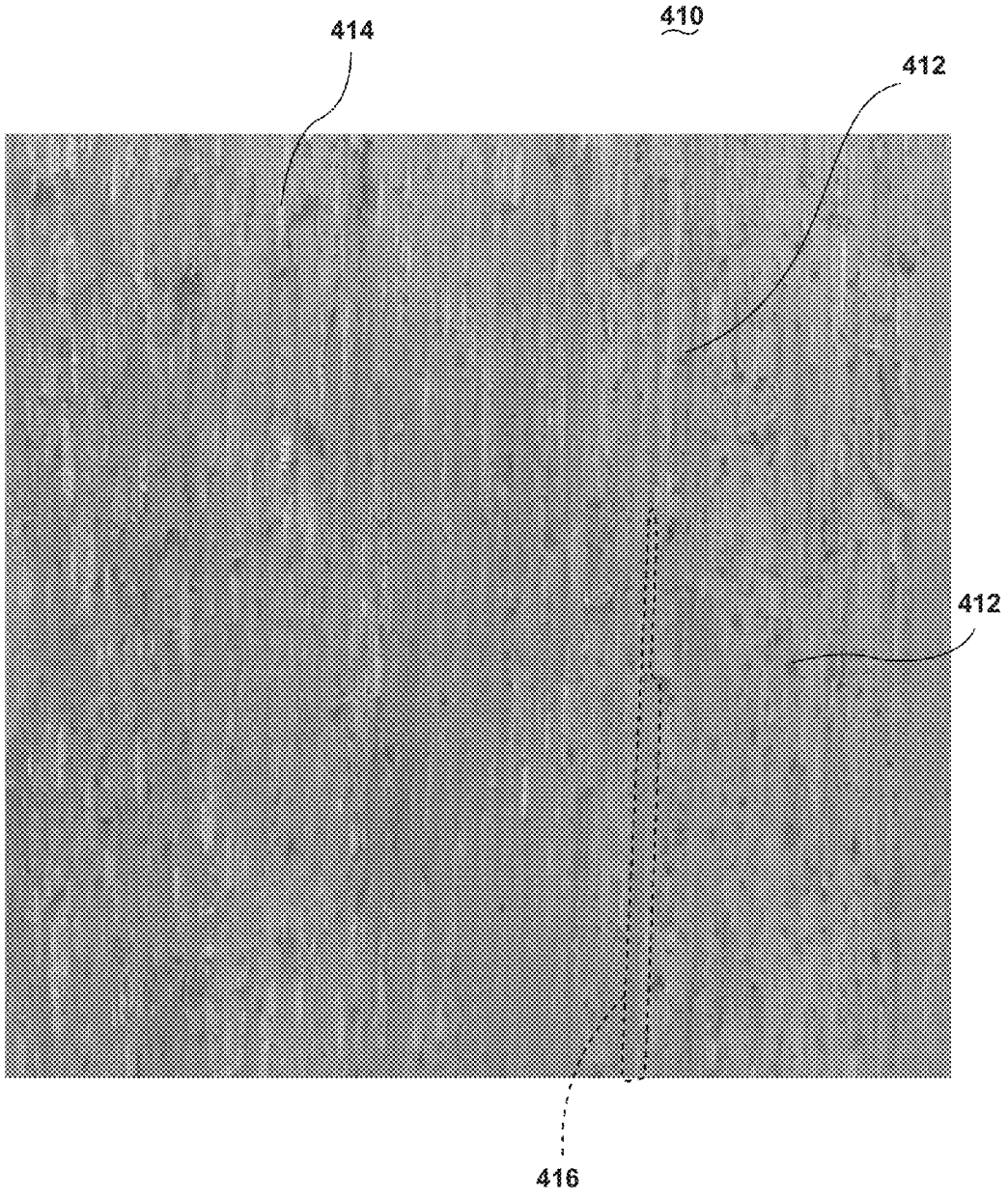
FIG. 6C is a photograph of the zoomed area indicated in FIG. 6A.

FIGS. 6A-C are photographs of an exemplary die drawn, filled OPC board 410 which has been split with a 70 degree wedge angle to provide a split surface 414 and then further treated with sanding, heat treatment and brushing. The exemplary board 410 was also made by solid state die drawing Formulation B in Table 1 below, which includes polypropylene and a talc filler. The sanding, heat treatment and brushing shortens a length of fibrils 412 formed by splitting the board 410 extending above the split surface 414, which provides the split surface 414 with a generally knobby fibrous surface rather than a stringy fibrous surface interspersed with areas of tear-out 416.

Figure 7:
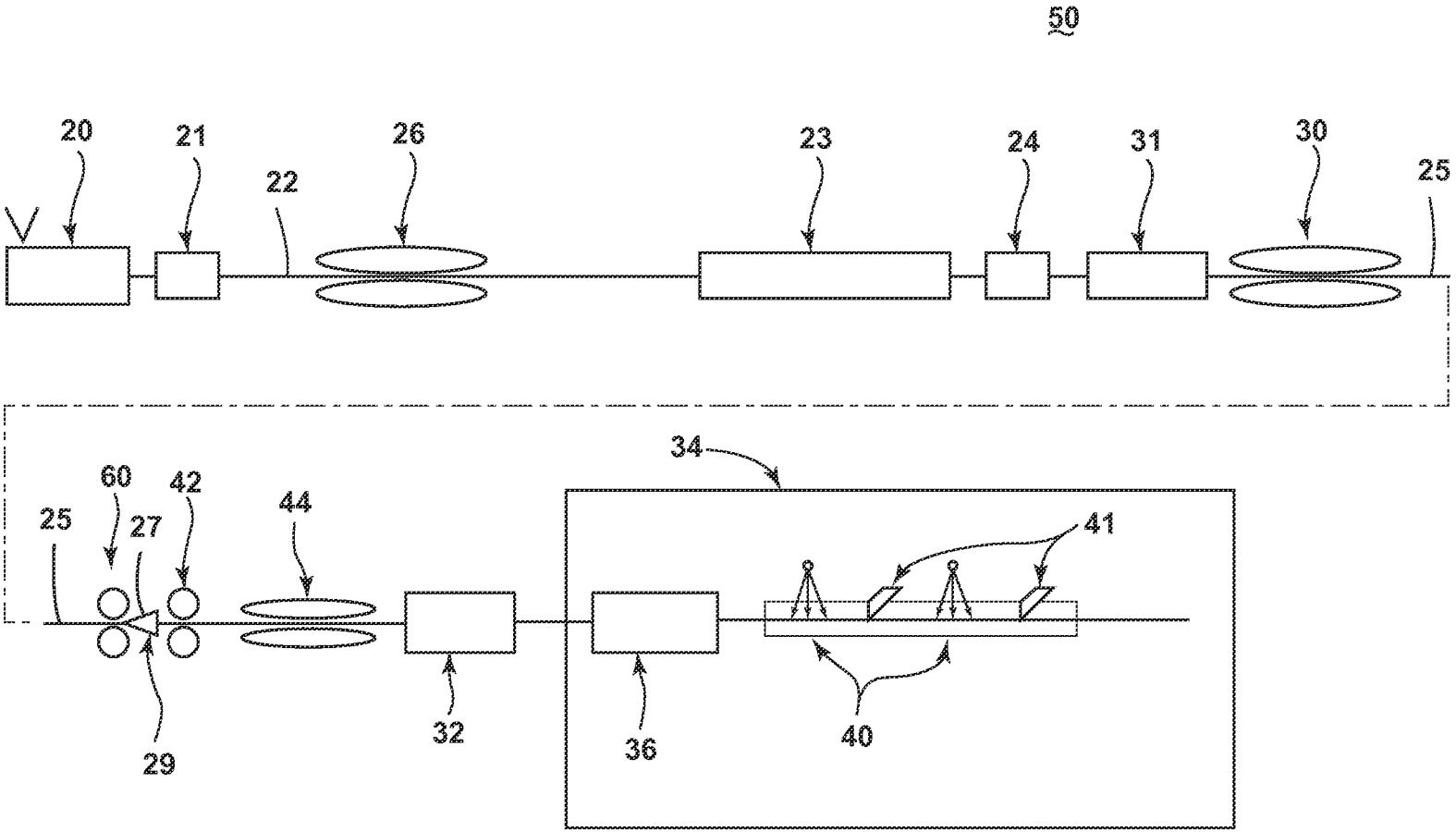
FIG. 7 illustrates an exemplary process of fabricating the oriented building product according to an embodiment of the invention.
Figure 8:
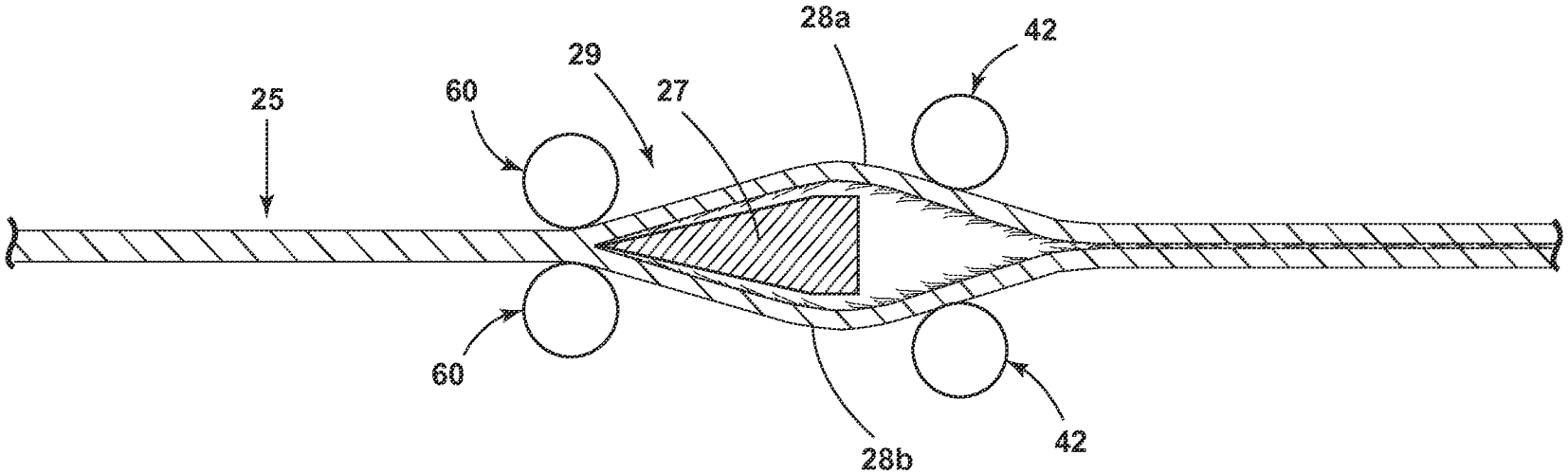
FIG. 8 illustrates a splitting station according to an embodiment of the invention.

FIG. 7 illustrates an exemplary process 50 for fabricating the board 10. Selected plastics materials and additives are introduced to an extruder 20 as a pre-compounded material or as individual components which can be compounded within the extruder 20 and, after processing in the extruder, are extruded through a die and calibrator 21 into a hot billet (extrudate) 22 of the extruded material which is drawn by rollers 26 into a temperature conditioning stage 23 to a die draw stage 24 where the material is cooled below its softening temperature Ts and drawn at a drawing temperature through a die to align long chains of the polymer in the lengthwise direction of drawing. As can best be seen in FIG. 8, after cooling with a cooling tank 31 to a splitting temperature (optional), the resulting work piece 25 is subsequently fed to a splitter 29 comprising a splitting wedge 27 where the work piece 25 is forced through a set of centering rolls 60 onto a splitting wedge 27 which divides the work piece 25 into two or more split sections or boards 28*a*, 28*b* (split work piece sections).

Referring back to FIG. 7, the work piece 25 can be pushed onto the wedge 27 using twin drive belts 30 to produce split boards 28*a* and 28*b*. Alternatively or additionally, twin belts 44 can be used to pull the work piece 25 onto the splitting wedge 27 to produce the split boards 28*a* and 28*b*, which can reduce bowing of the split sections. The process may be operated with both sets of drive belts 30 and 44. Optional rolls 42 can also be used and can facilitate aligning the split boards and guiding the split boards to drive belts 44. Optionally, after cooling at 31, at least one surface of the work piece 25 may be heated above its softening temperature to de-orient the polymers proximate the surface to create a de-oriented surface layer, preferably of greater than 100 microns in thickness, either before or after splitting at splitter 29, but preferably before splitting.

Still referring to FIG. 7, the split boards 28*a* and 28*b* may be cut to a desired length (and optionally width) at a cutting station 32, or may undergo further post-splitting treatment before or after being cut to length through a further processing stage 34. The processing stage 34 may include one or more sanding/brushing/scraping stations 36 and one or more heat treatment/flaming stations 40. After heat treatment, the surface may be scraped by scrapers 41 to remove melted nubs to make the surface appear more wood-like. Prior to entering the processing stage 34, the split sections 28*a*, 28*b* may be turned by 90 or 180 degrees to orient the formerly inwardly facing split sections surfaces outwardly so they are more accessible to the various stations of the processing stage 34. The split sections 28*a*, 28*b* may be cut to a suitable length after stage 34.

In an exemplary embodiment, the board 10 can be made from an oriented polymer composition comprising a continuous phase of one or more orientable polymers. Preferably, 90 wt % or more, and more preferably, 95 wt % or more of the polymers in the polymer composition are orientable polymers. Alternatively, all of the polymer in the polymer composition can be orientable.

As described above, an orientable polymer is a polymer that can undergo polymer alignment. Orientable polymers can be amorphous or semi-crystalline. Herein, "semi-crystalline" and "crystalline" polymers interchangeably refer to polymers having a melt temperature (Tm). Suitable orientable polymers are one or more than one semi-crystalline polymer, particularly polyolefin polymers (polyolefins) which tend to readily undergo cavitation in combination with filler particles. While not meant to be limited by any theory, polyolefins are believed to undergo cavitation in combination with filler particles because polyolefins are relatively non-polar and as such adhere poorly to filler particles. Linear polymers (that is, polymers in which chain branching occurs in less than 1 of 1,000 monomer units such as linear low density polyethylene) are even more preferable.

Non-limiting examples of suitable orientable polymers include polymers and copolymers based on polystyrene, polycarbonate, polypropylene, polyethylene (for example, high density, very high density and ultra high density polyethylene), polyvinyl chloride, polymethylpentane, polyamides, polyesters (for example, polyethylene terephthalate) and polyester-based polymers, polycarbonates, polyethylene oxide, polyoxymethylene, and combinations thereof. A first polymer is "based on" a second polymer if the first polymer comprises the second polymer. For example, a block copolymer is based on the polymers comprising the blocks. Preferred orientable polymers include polymers based on polyethylene and polypropylene, examples of which include linear polyethylene having Mw from 150,000 to 3,000,000 g/mol; especially from 300,000 to 1,500,000 g/mol, even from 750,000 to 1,500,000 g/mol.

Polypropylene (PP)-based polymers (that is, polymers based on PP) are one example of a preferred orientable polymer for use in the present invention. PP-based polymers generally have a lower density than other orientable polyolefin polymers and, therefore, facilitate lighter articles than other orientable polyolefin polymers. PP-based polymers also offer greater thermal stability than other orientable polyolefin polymers. Therefore, PP-based polymers, made by any of the means known in the art may also form oriented articles having higher thermal stability than oriented articles of other polyolefin polymers. Suitable PP-based polymers include PP homopolymer; PP random copolymer (with ethylene or other alpha-olefin present from 0.1 to 15 percent by weight of monomers); PP impact copolymers It is desirable to use a PP-based polymer that has a melt flow rate, in grams per ten minutes of 0.8 to 12, preferably 1 to 8, more preferably 2 to 6 and still more preferably 2 to 4. It is also preferred to use a PP-based polymer that has 55 to 70%, preferably 55 to 65% crystallinity.

PP obtained from either industrial or commercial recycle streams, including filled or reinforced recycled PP, may be used as long as the polymer (or polymer phase) meets the melt flow requirements above. The recycled PP may range from 0 to 100% of the orientable polymer used in the orientable polymer composition.

PP can be ultra-violet (UV) stabilized, and desirably can also be impact modified. Particularly desirable PP is stabilized with organic stabilizers. The PP can be free of titanium dioxide pigment to achieve UV stabilization thereby allowing use of less pigment to achieve any of a full spectrum of colors.

The oriented polymer composition can further comprise inert inorganic filler. Inorganic materials do not suffer from all of the handicaps of organic fillers. Organic fillers include cellulosic materials such as wood fiber, wood powder and wood flour and are susceptible even within a polymer composition to color bleaching when exposed to the sun, and to decomposition, mold and mildew when exposed to humidity. Inorganic fillers are either reactive or inert. Inert fillers can be more preferred than reactive fillers in order to achieve a stable polymer composition density. However, inorganic fillers are generally denser than organic fillers. For example, inert inorganic fillers for use in the present invention typically have a density of at least two grams per cubic centimeter. Therefore, polymer compositions comprising inorganic fillers typically contain more void volume than a polymer composition comprising the same volume of organic fillers in order to reach the same polymer composition density.

Non-limiting examples of suitable inert inorganic fillers include talc, clay (for example, kaolin), magnesium hydroxides, aluminum hydroxides, dolomite, titanium dioxide, glass beads, silica, mica, metal fillers, feldspar, Wollastonite, glass fibers, metal fibers, boron fibers, carbon black, nano-fillers, calcium carbonate, and fly ash. Particularly desirable inert inorganic fillers include talc, calcium carbonate, and clay. The inorganic filler can comprise one, or a combination of more than one, inorganic filler. More particularly, an inert inorganic filler can be any one inert inorganic filler or any combination of more than one inert inorganic filler.

Optionally, coloring or streaking techniques known in the art to provide a non-uniform color pattern to the interior of the board 10 may be used to give additional aesthetic appeal to the split surface 12 of the board 10.

Solid state die drawing is different from extrusion (in which the material is pushed through a die in a hot, flowable state above the glass transition temperature Tg of the material) or even pultrusion (where the material can be both pushed and pulled). Solid state die drawing for making the boards 10 to be subsequently split to yield the split surface 12 involves pulling the material having a softening temperature Ts at a temperature below its melt temperature Tm through a drawing die via drive rollers or drive tracks or belts so that the material is under a state of tension. The die drawing can occur at a drawing temperature Td below the polymer composition softening temperature Ts at ten or more degrees below the softening temperature, including 15, 20 or even 30 degrees below Ts, for example. Generally, the drawing temperature Td range is 40° C. or less below the polymer composition's Ts in order to use economically reasonable draw rates and to achieve a desirable void volume through cavitation in a polymer composition having all cross sectional dimensions greater than 1.5 mm. It is preferred to maintain the temperature of the polymer composition at a temperature within a range between the polymer composition's Ts and 50° C. below Ts inclusive of endpoints, while the polymer composition is drawn.

This causes the long polymer chains of the material to elongate (or straighten) and generally align in the direction of drawing to yield a generally aligned fibrous long chain polymer structure of the material. The individual polymer chains or groups of polymer chains can be somewhat intertangled and also mechanically bonded to one another such that there is great resistance to splitting the material in the lengthwise direction, or for that matter in any direction, giving the material great strength and toughness that can be greater than that of cedar wood normally used to make wood shakes.

Insufficient orientation of the polymer chains during the solid state die drawing process gives a smooth surface when split that does not provide the desired three-dimensional, fibrous appearance. Thus it is preferred that the linear draw ratio is greater than 4, more preferably greater than 5 and still more preferably greater than 6 and even more preferably greater than 7. However, when the linear draw ratio is as high as 8 or greater, additional surface finishing steps are desirable to reduce the number and size of gouges and surface fibers.

The flexural modulus is affected by the linear draw ratio, and is one measure of an average degree of orientation of the oriented polymer composite. Thus, the higher the flexural modulus the more oriented and fibrous can be a filled OPC article. A low flexural modulus represents a less fibrous nature. However, if void volume is introduced into the OPC article, either by cavitation during the drawing process or by the addition of a foaming agent, the measured flexural modulus can understate the actual degree of orientation in the OPC article because the void volume leads to overall reduced mass of the OPC article. One way to correct for this effect can be to divide the flexural modulus by the density, thus normalizing the flexural modulus as if no void volume were present. The density corrected flexural modulus is the flexural modulus in gigaPascals (GPa) divided by the density in grams per cubic centimeter (g/cc). Thus, in order to produce a split surface with fibrous aesthetics, it is preferable for the work piece 25 to have a density corrected flexural modulus greater than 2.4 GPa, preferably greater than 2.8 GPa, or more preferably greater than 3.0 GPa, or even more preferably greater than 3.4 GPA and yet even more preferably greater than 3.8 GPa. Desirable articles can be produced when the density corrected flexural modulus is as high as 4.0 GPa or even higher. However, when the density corrected flexural modulus is as high as 4.5 GPa or greater, additional surface finishing steps are desirable to reduce the number and size of gouges and surface fibers.

Fillers and additives are incorporated with the orientable polymer to make the orientable polymer composition. Such fillers function as impediments to polymer chain alignment during solid state drawing and have the effect of introducing cavitation into the material as the polymer chains are forced to slide past the particles during chain elongation. Such cavitation reduces the density of the composite polymer material and may further benefit the splitting of the work piece 25 at splitting station 29 by helping to define lower resistance paths of separation through the material. The filler particles can vary in size, shape and selection (blends) to control the level and character of the cavitation and may influence the behavior and outcome of the splitting of the oriented polymer composite work piece (force required, rate of splitting, texture, appearance, etc.) Other additives may include pigments, fire retardants, and additives known in the art. Some of these fillers, such as fire retardants, may comprise hard particles and may have a beneficial dual purpose as both a fire retardant and as a portion of, or all, the filler constituent of the material composition if cavitation of the material is desired. More particularly, the inert inorganic filler can be any one inert inorganic filler, or any combination of more than one inert inorganic filler. Embodiments of the invention can have 25% or more and even 35%, 45%, 50% or even 60 wt % filler (based on polymer composition weight). Embodiments in which the filler level in between about 40 wt % and 60 wt % are preferred.

Generally, the extent of cavitation (that is, amount of void volume introduced due to cavitation) may be directly proportional to filler concentration. Increasing the concentration of inorganic filler can increase the density of a polymer composition, but also may increase the amount of void volume resulting from cavitation. Particularly desirable embodiments of the present filled oriented polymer composition article have 25 volume-percent (vol %) or more, preferably 35 vol % or more, more preferably 45 vol % and even 50 vol % or more void volume based on total polymer composition volume.

While not wishing to be bound by theory, it is believed that the number and size of crack propagation sites affect the surface characteristics observed on splitting of the work piece 25 and can be dependent on the manner of compounding or blending of the filler into the thermoplastic. Although fully compounded material is a satisfactory feedstock for a split OPC article of the invention, it is believed that when not fully compounded (blended) with the polymer base material, pockets or lines of concentrated filler deposits can act as crack propagation sites so that when the material is mechanically split, the filler sites act as weak points in the bulk material allowing the long polymer strands to pull from the base material and not be cut or broken as the splitting tool follows the path of least resistance during the splitting process and appearing as fibers or fibrils on the split surface. It is believed that this mechanism promotes a split surface with more "tear-out" and longer larger fibrils and greater tear out than is the case in which the filler is uniformly compounded.

Additional void volume may be created by the use of foaming agents, either exothermic or endothermic. Herein, "foaming agent" includes chemical blowing agents and decomposition products therefrom. Foaming agents include, but are not limited to moisture introduced as part of a filler, for example wood flour or clay, or by chemicals that decompose under the heating conditions of the billet extrusion process, Chemical blowing agents include the so-called "azo" expanding agents, certain hydrazide, semi-carbazide, and nitroso compounds, sodium hydrogen carbonate, sodium carbonate, ammonium hydrogen carbonate and ammonium carbonate, as well as mixtures of one or more of these with citric acid or a similar acid or acid derivative. Another suitable type of expanding agent is encapsulated within a polymeric shell. A particularly suitable chemical blowing agent is Acculite-401 (GMA-401) sold by KibbeChem Inc., Elkhart Ind. This blowing agent may be used up to at least 1.5% blowing agent to achieve density reductions compared to an unfoamed billet of up to 20% or even more. Measure wt % blowing agent relative to total oriented polymer composition weight.

According to an embodiment of the invention, the introduction of additional void volume, via blowing agents, can be used to help control the surface appearance of the split OPC. For example, in some instances, excessive tear out can occur and addition of blowing agent leads to a surface with reduced tear out compared to an equivalent filled OPC made without blowing agent. It is believed that added amounts of blowing agent affect the number and size of small voids and fibrils, which exist between and around the voids and the filler(s), of the filled OPC. These thinner fibrils may be more easily cut during the splitting process which leads, in turn, to reduced tear out compared to a split surface of an equivalent filled OPC produced without additional blowing agent. Thus it is desirable for the split article to have a density less than 1.0 g/cc, preferably less than 0.9 g/cc, more preferably less than 0.8 g/cc and still more preferably less than 0.7 g/cc. It is desirable that the density not be too low as the aesthetic similarity to wood of the split OPC article declines as density is decreased. It is desirable that the density be greater than 0.4 g/cc, preferably greater than 0.5 g/cc and more preferably greater than 0.6 g/cc. The combination of material having a predetermined orientation, as defined by the density corrected flexural modulus, and a predetermined density can be used to produce a split surface with desirable fibrous aesthetics.

As described above, the polymer composition can optionally be cooled at cooling tank 31 after exiting the drawing die 24 prior to splitting because it is desirable that the splitting temperature is below the softening temperature so that that the filled OPC work piece 25 can be cut by the wedge during the splitting process. If the work piece 25 is not far enough below its softening temperature Ts when it is split, for some materials, the polymer strands can deform rather than be cut by the wedge 27. Furthermore, it is desirable for a continuous splitting operation, that the characteristics of the split surface are relatively insensitive to the splitting temperature so that upsets or changes in other parts of the process have no, or only a limited effect, on the splitting process and product characteristics. The splitting temperature may be as high as 50 degrees Celsius, 90 degrees Celsius or even as high as 145-166 degrees Celsius. While performing the splitting operation above the softening temperature is contemplated within this invention, it has been found that desirable results occur for the splitting operation at approximately at least 25 degrees below the softening temperature Ts, and may be as low as ambient temperature or even lower, depending on the material and other processing conditions, and still yield an OPC article with the desired look and split fibrous texture of real wood shakes.

It is understood within the art that a polymer composition can have a variation in temperature through its cross section (that is, along a cross sectional dimension of the composition) during splitting. Therefore reference to temperature of a polymer composition, particularly to a drawing temperature or a splitting temperature, refers to an average of a high and low temperature along a cross section of the polymer composition. The temperature at two different points along the polymer cross sectional dimension can vary by 10% or less, preferably 5% or less and more preferably by 1% or less from the average temperature of the highest and lowest temperature along the cross sectional dimension. The temperature can be measured in degrees Celsius (C) along a cross sectional dimension by inserting thermocouples to different points along the cross sectional dimension, as is known in the art.

Referring again to FIG. 8, at the splitter station 29 work piece 25 passes between twin drive belts 30, which act to drive the work piece 25 with sufficient force and speed against the splitting wedge 27. Immediately upstream of the splitting wedge 27 is at least one set of guide rolls 60 which align and support the OPC work piece 25 in the direction of its thickness to keep the OPC work piece 25 located in the thickness dimension relative to the wedge 27. In one embodiment, process and product flexibility are added when the locating means and the wedge are adjustable with respect to one another, so that the OPC work piece need not be split down its center. In one preferred embodiment, the center line of the OPC work piece and of the wedge are coplanar with respect to one another to produce a generally uniform and equal splitting (allowing for the natural variability of the splitting process) of the OPC board to give split OPC board sections 28*a*, 28*b*. There may be at least one additional set of guide rolls 42 positioned immediately downstream of the splitting wedge 27.

The set of guide rolls 60 upstream of the splitting wedge 27 and the splitting wedge 27 itself preferably are equipped with adjustment means (not shown) to facilitate alignment of the work piece with the splitting wedge. These may be of any type known in the art and may be computer or manually controlled. It is also preferable that the guide rolls and the splitting wedge are securely fastened so that they are unable to change positions with respect to one another once they have been adjusted as required.

The material of the splitting wedge may be any suitable material including metal, for example steel, or ceramic. The leading edge of the splitting wedge (knife edge) that has the first contact with the OPC work piece can be a straight edge, a serrated edge or saw tooth edge or any other known in the art. In one embodiment, a straight edge is preferred. It is preferably fabricated to maintain a hard sharp edge as is known in the art.

The splitting wedge may be symmetric or asymmetric about its central plane as might be required. When a symmetric splitting wedge is used, the angle between the upper surface of the splitting wedge and the lower surface (wedge angle) of the splitting wedge lies between 90 degrees and about 10 degrees. The length of a line from the front or splitting edge of the wedge and the downstream side of the wedge along the center of the board is typically 2.5 centimeters (cm) or more, 5 cm or more or even 10 cm or more, and may be any length desired. However, the longer is this length, the more massive will be the wedge, and consequently more expensive. When a splitting wedge of larger angle is used, more splitting and tearing force is exerted upon the OPC board faces being split by the splitting wedge, resulting in deeper gouges (more tear out) than observed with a splitting wedge of smaller angle for OPC boards of the same composition and drawing ratio. In most cases it is preferred that the splitting wedge angle is less than 70 degrees, and preferably less than 50 degrees and greater than 5 degrees, more preferably greater than 20 degrees. The lower limit of the splitting wedge angle can be limited by the stress placed upon the edge during the splitting operation. A particularly desirable wedge is one which is comprised of multiple parts in which a replaceable wedge splitting edge is supported by a wedge body. Non-limiting examples include: a multi-part wedge wherein the tip of the cutting edge is fastened to a leading face of the wedge; a three part wedge in which a beveled cutting knife is held between two support pieces, which support pieces serve to move the split work piece sections out of the path of the knife.

The splitting wedge may consist of one or more splitting sections wherein the central plane of the splitting wedge is parallel to the central plane of the work piece 25 as it approaches the wedge. In an embodiment in which one splitting wedge is used, as in FIG. 5, the central plane of the single splitting wedge and the central plane of the work piece 25 are essentially coplanar.

If desired, channels to carry fluid for heating or cooling of the wedge may be fabricated into the wedge. Maintaining the temperature of the wedge below the temperature of the work piece when the splitting station is being operated in a continuous process can be advantageous.

The means to pull or push the OPC work piece onto the splitting wedge may be any known in the art. A convenient arrangement is one in which a pulling force (or pushing force) is exerted on the OPC work piece by a pulling (or pushing) device, such as for example, a dual belt puller or a caterpillar situated downstream of the wedge. This arrangement brings the split surfaces of the split OPC boards back together and is believed to reduce bowing of the split OPC boards as a result of stressed introduced into the OPC work piece by the splitting process The techniques for improving the surface appearance of the split boards 28*a*, 28*b* in the processing stage 34 can be independent of the splitting process and can be used with any splitting process known in the art. A brush/sander/scraper 36 can be used to remove any loose strands from the split surface 12 of the split boards 28*a*, 28*b*. If brushing/sanding/scraping is done off-line (not-continuously) with the splitting, two brushing/sanding/scraping stages can be used in which the direction of the board through the stage is reversed. Heating treatment stations 40 may use flame heating, forced hot air heating, infrared heating or any means known in the art. The heat treatment stage 40 can improve the aesthetics of the split surface appearance by darkening the split surface 12 of the split boards 28*a*, 28*b* and by melting fibrous strands that can project far above the board surface and give a fuzzy, undesirable look to the split boards 28*a*, 28*b*. Overheating is undesirable as it can give the heated area a glossy plastic appearance. During the heating and melt back process, portions of melted back polymer strands are produced (nubs) which may be removed in the brushing or scraping stage 41. Typically there is less melt back and brushing/sanding/scraping required in the second of the two heating 40 and brushing/sanding/scraping 41 stations illustrated. If required, additional heating and brushing/sanding/scraping stations may be added. After processing stage 34, the OPC board may be cut to a desired length as is known in the art.

EXAMPLES

The following examples illustrate embodiments of the present invention and not necessarily the full scope of the present invention. After splitting the work piece to produce the split boards, the split boards can be characterized by flexural modulus, density and surface characteristics, which are described in the following Examples and Comparative Examples.

An OPC can be prepared by feeding components together in a specific weight ratio either as individual components or in any combination of pre-compounded compositions to an extruder. The oriented polymer composition contains the formulations as included in Table 1. The orientable polymer composition has a softening temperature of approximately 163° C. The extruder heats and mixes the orientable polymer composition into a billet, which continues through a calibrator and cooling station to stabilize the billet dimensions. The billet is then thermally conditioned to a drawing temperature approximately 20° C. below the softening temperature of the orientable polymer composition.

The OPC composition can then be continuously fed through a converging solid state drawing die using haul-offs, for example caterpillar pullers) to produce an OPC article. The OPC can be drawn through the converging die at a draw rate of approximately 6-10 feet per minute. The solid state drawing die has a shaping channel that converges, and preferably continuously converges, to produce the OPC.

The resulting OPC article having cross sectional dimensions of approximately 0.762 cm by 14 cm, is fed to a splitting station and forced around a wedge using a caterpillar puller (Custom Downstream Systems, CCH 48-8V) with the splitting conditions and results for the semi-continuous process shown in Tables 2 and 4, respectively, and the splitting conditions and results for the continuous process shown in Tables 3 and 5, respectively.

TABLE 1

Formulations used for making oriented polymer composite work pieces for splitting

| Formulation | Polymer Type (wt %) | Filler type | Filler amount (wt %) | Additional foaming agent (wt %) | Pre-compounded | Other (wt %) |
|---|---|---|---|---|---|---|
| A | 52% PP Inspire D404 | Talc | 46 | No | Yes | Lubricant - 2%; |
| B | 47% PP Inspire D404 | Talc | 47 | No | Yes | Color and UV stabilizer - 4%, Lubricant - 2% |
| C | 45.8% PP | Calcium carbonate | 50 | 0.2% GMA 401 | Yes | Lubricant 2%; 2% color concentrate gray |
| D | 50% PP | Talc | 45 | No | No | Lubricant 2%; 2% color concentrate |

TABLE 1-continued

Formulations used for making oriented polymer composite work pieces for splitting

| Formulation | Polymer Type (wt %) | Filler type | Filler amount (wt %) | Additional foaming agent (wt %) | Pre-compounded | Other (wt %) |
|---|---|---|---|---|---|---|
| E | 25.8% PP 17.5% recycle PP | Blend Talc/ Calcium carbonate | 22.1/33 | 0.3% GMA 401 | Yes | Lubricant - 1.6% |
| F | 42.8% PP | Calcium carbonate | 50 | 0.2% GMA 401 | 50% Yes, 50% No | Lubricant - 2%; 5% color concentrate |
| G | 47.5% PP | Calcium Carbonate | 50.3 | 0.3% GMA 401 | No | Lubricant - 1.8% |
| H | 47.4% PP | Calcium Carbonate | 50 | 0.26% GMA 401 | No | Lubricant - 2.04% |
| I | 42.75 PP 4.8% recycle PP | Talc | 49.95 | 0.25% GMA 401 | No | Lubricant - 2.0% |

Inspire D404 polypropylene (PP) is supplied by The Dow Chemical Co, Midland MI.
Recycle PP - PP 1020 - SC0655885 with melt flow of 6-10 g/10 min and was supplied by Muehlstein US, Norwalk CT.
Talc is Talc TC100 supplied by Imerys, Société Anonyme, Paris France.
Lubricant was Baerolub W94112Tx supplied by Baerlocher USA, Cincinnati OH.
Calcium carbonate is grade #10 white, supplied by Imerys, Société Anonyme, Paris France.

TABLE 2

Drawing Conditions - Semi-continuous process

| Example Number | Formulation | Linear Draw Ratio | Flexural Modulus (GPa) | Density (g/cc) | Density corrected flexural modulus/ Density | Splitting Temperature | Wedge Angle (degrees) |
|---|---|---|---|---|---|---|---|
| 1 | A | 9 | 5.52 | 0.8 | 6.9 | ambient* | 24 |
| 2 | A | 9 | 5.52 | 0.8 | 6.9 | ambient | 70 |
| 3 | B | 9 | 3.79 | 0.80 ± .03 | 4.73 | ambient | 24 |
| 4 | B | 9 | 3.79 | 0.80 ± .03 | 4.73 | ambient | 70 |
| 5 | C | 7 | 2.41 | 0.74 | 3.24 | ambient | 24 |
| 6 | C | 7 | 2.41 | 0.74 | 3.24 | ambient | 70 |
| 7 | D | NA | 4.48 | 0.92 | 4.86 | ambient | 24 |
| 8 | D | NA | 4.48 | 0.92 | 4.86 | ambient | 70 |
| 9 | C | 7 | 2.41 | 0.74 | 3.24 | 166C | 24 |
| 10 | C | 7 | 2.41 | 0.74 | 3.24 | 166C | 70 |
| 11 (comparative) | E | 3.75 | 1.5 | 0.68 | 2.2 | ambient | 24 |
| 12 (comparative) | G | 3.5 | 1.03 | 0.61 | 1.71 | ambient | 24 |
| 13 | G | 4.25 | 1.79 | 0.65 | 2.75 | ambient | 24 |
| 14 | G | 7.25 | 2.41 | 0.63 | 3.82 | ambient | 24 |
| 15 | H | 6 | 1.42 | 0.53 | 2.67 | ambient | 24 |
| 16 | I | 5.5 | 2.04 | 0.62 | 3.29 | ambient | 24 |
| 17 | I | 5 | 1.91 | 0.63 | 3.03 | ambient | 24 |

*Ambient temperature varies between about 15° C. and 30° C.

TABLE 3

Drawing Conditions - Continuous on-line splitting

| Example | Formulation | Linear Draw Ratio | Flexural Modulus (GPa) | Density (g/cc) | Density corrected flexural modulus/ Density | Splitting Temperature | Wedge Angle (degrees) |
|---|---|---|---|---|---|---|---|
| 18 | F | 8 | 2.71 | 0.73 | 3.71 | Not available* | 24 |

*spitting was continuous after die drawing

TABLE 4

| Results for Examples of Table 2 | |
|---|---|
| Example Number | Observations of splitting process and split product |
| 1 | Smooth split surface. There are few fibrillations apparent over most of the split surface - Acceptable surface. |
| 2 | Smooth split surface. There are few fibrillations apparent over most of the split surface - Acceptable surface. |
| 3 | Smooth split surface. There are few fibrillations apparent over most of the split surface - Acceptable surface. |
| 4 | Smooth split surface. There are few fibrillations apparent over most of the split surface. The 70° wedge resulted in deeper gouges than 24 wedge but there was still few fibrillations over most of the torn surface. Acceptable surface. |
| 5 | Many loose fibrillations. Relatively uniform surface with lots of fine fibrillations when using 24° wedge. Acceptable surface. |
| 6 | Many loose fibrillations. Rough split surface with many ridges and deeper gouges when using 70° wedge. Acceptable surface. |
| 7 | Many loose fibrillations. Relatively uniform surface with lots of fine fibrillations when using 24° wedge. Acceptable surface. |
| 8 | Many loose fibrillations. Rough split surface with many ridges and deeper gouges when using 70° wedge. Acceptable surface. |
| 9 | Highly fibrillated interior strands at the split surface. Acceptable surface. |
| 10 | Highly fibrillated interior strands at the split surface. Acceptable surface. |
| 11 (comparative) | Relatively uniform split surface no fine fibrillations on the surface. This sample does not exhibit a very wood-like appearance |
| 12 (comparative) | No fibrillation, relatively smooth surface-not suitable as a shake |
| 13 | No fibrillation, surface has some roughness, more like rough sawn than split. Marginally suitable as a shake |
| 14 | Fibrillated surface, suitable for use as a shake |
| 15 | Many loose fibrillations. Rough split surface with many ridges - Marginally acceptable surface. |
| 16 | Some loose fibrillations. Rough surface but uniform and level with no ridges. Acceptable surface. |
| 17 | A few loose fibrillations - just on edge of wood-like appearance. Rough surface but uniform and level with no ridges. Acceptable surface. |

TABLE 5

| Results for Examples of Table 3 | |
|---|---|
| Example | Observations of splitting process and split product |
| 18 | Surfaces have significant variability in number of fibrillations and gouges. Samples have many loose fibrillations making them useful as wood-like shake samples. Acceptable surface. |

Examples 1 through 10 are pairs of examples in which the splitting angle of the wedge is either 24 or 70 degrees. Comparing members of each pair shows the effect of wedge angle on the surface characteristics. Splitting using a wedge angle of 70 degrees typically yields a rougher split surface with more areas of tear out compared to a surface split using a 24 degree angle wedge, which generally produces finer surface fibrils, as exemplified in FIGS. 4A-C and FIGS. 5A-C discussed above.

Examples 1 through 18 illustrate the effect of draw ratio and density corrected flexural modulus on the properties of the resulting split product. Examples 1 through 10 and 13-18 illustrate that products that were drawn at a linear draw ratio from as low as 4.25 up to 9 and a density corrected flexural modulus as low as 2.67 up to 6.9 GPa provide split products having surface characteristics such as random and non-uniform areas of fibrils of varying dimensions and indications of "tear-out" or gouges, representative of the surface of split real wood that render the products suitable for use as a shake-type product. In contrast, comparative examples 11 and 12, in which the linear draw ratio is less than 4 and the density corrected flexural modulus is less than 2.4 GPa, did not result in split products having the fibril or tear-out surface characteristics which are representative of the surface of real split wood and thus would not be considered suitable for use as a shake-type product.

As discussed above, the linear draw ratio during the solid state drawing process used to form the work piece before it is split affects the orientation of the polymer chains. As illustrated by the comparative examples of 11 and 12, linear draw ratios below 4 provide insufficient orientation of the polymer chains during the drawing process, which results in a smooth surface when the product is split. Density corrected flexural modulus, which is affected by the linear draw ratio and the density of the work piece, is one measure of the average degree of orientation of the oriented polymer composite forming the work piece. As indicated by the examples in Table 2, work pieces having a density corrected flexural modulus above 2.4 GPa had sufficient polymer chain orientation such that the split product exhibited surface characteristics comparable to real-wood shake products, such as random and non-uniform areas of fibrils of varying dimensions and indications of "tear-out" or gouges. In contrast, when the orientation of the polymer chains was insufficient, as indicated by a density corrected flexural modulus less than 2.4 GPA, the split product did not exhibit fibrous surface characteristics and areas of tear-out comparable to real-wood shake products and instead produced a relatively smooth split surface.

Comparing Examples 5 and 6 to Examples 9 and 10 shows that the splitting temperature can vary from room temperature to as high as the softening temperature of the polymer and still yield a product with the desired fibrous appearance of real split wood shakes when the linear draw ratio is greater than 4 and the density corrected flexural modulus is greater than 2.4 GPa.

Figure 9A:
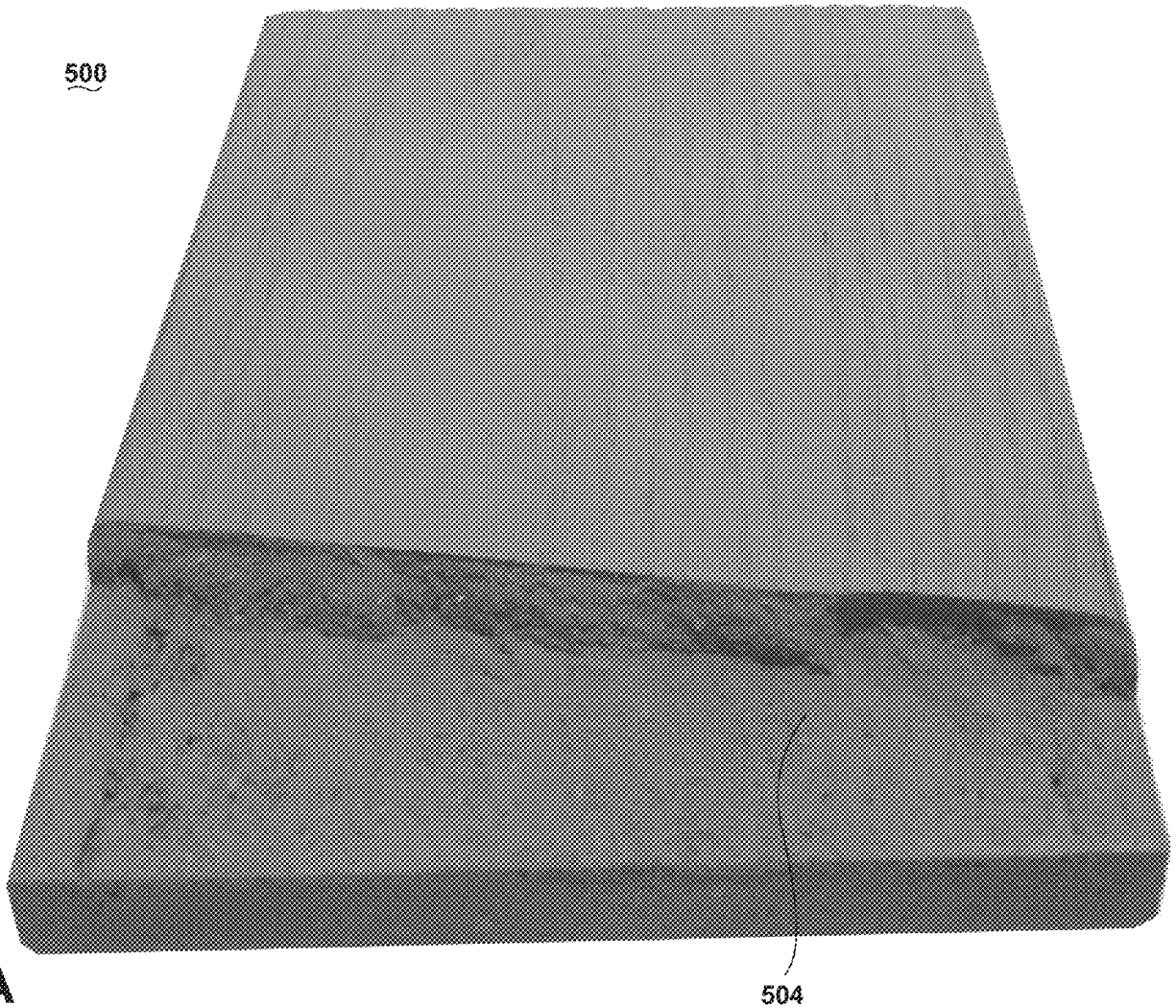
FIGS. 9A-9B are photographs of a commercially available composite boards formed by extruding a filled polymer composite which have been moved against a splitting wedge.
Figure 9B:
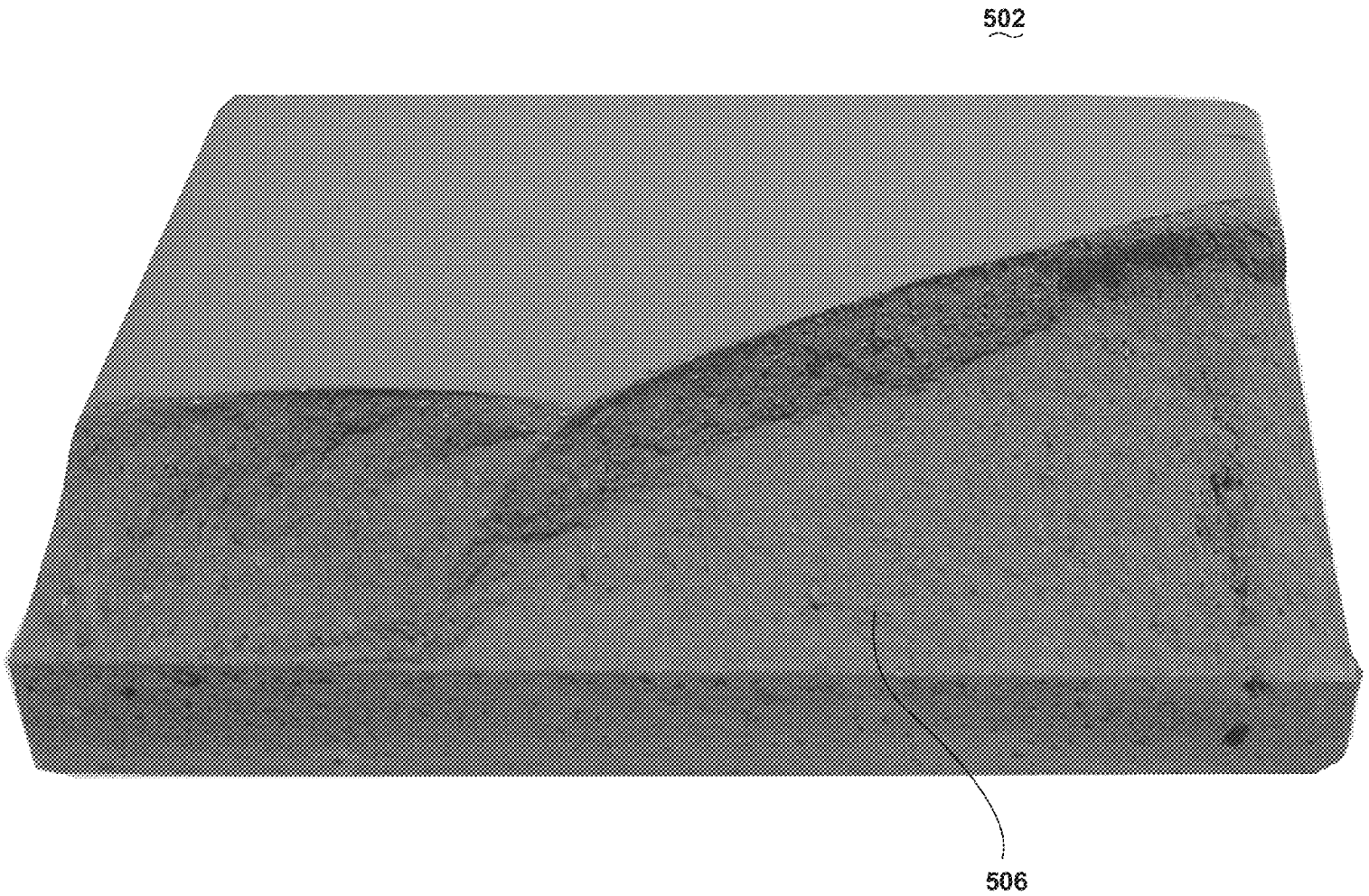
Figure 10A:
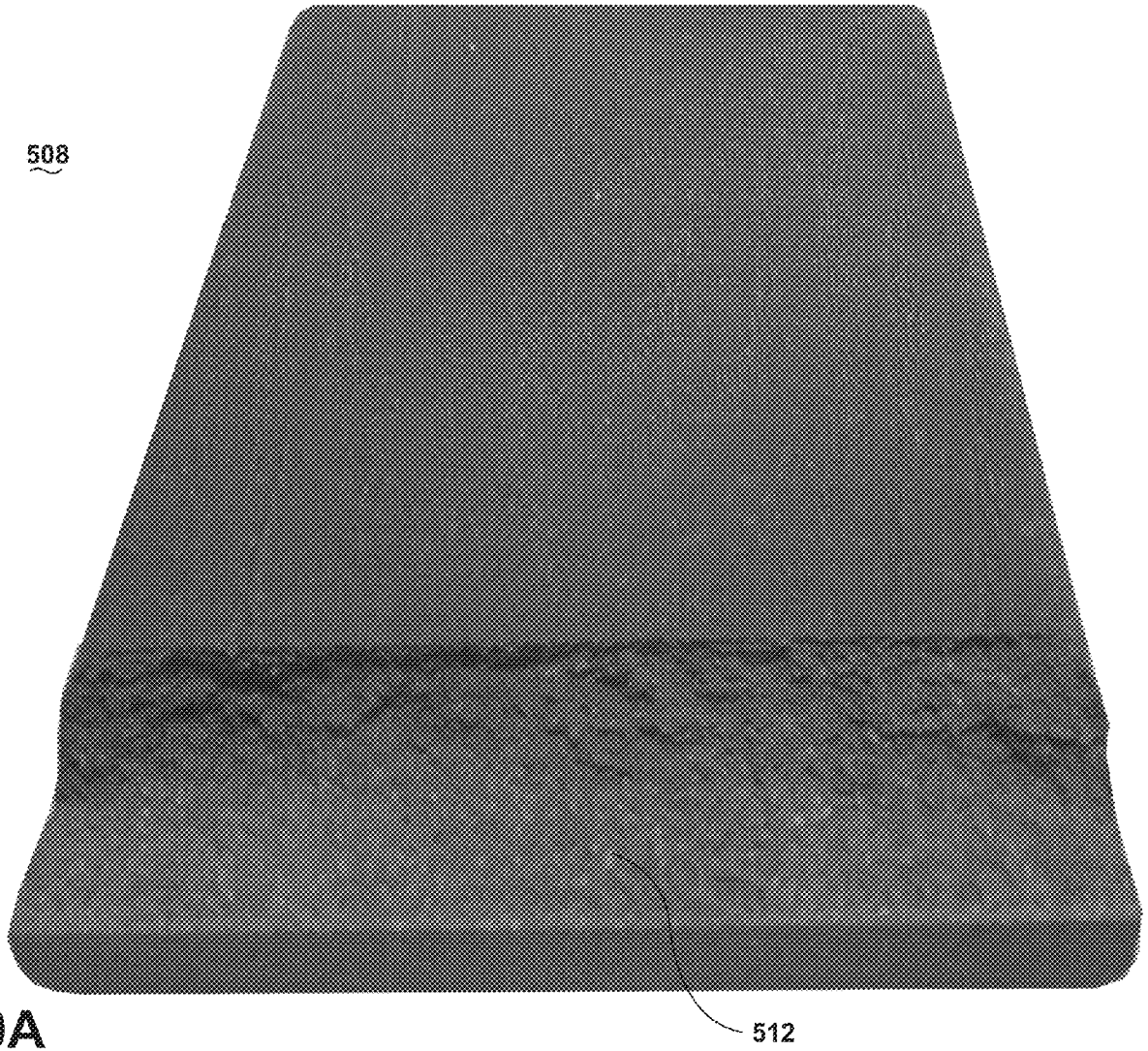
FIGS. 10A-10B are photographs of a commercially available composite boards formed by extruding a filled polymer composite which have been moved against a splitting wedge.
Figure 10B:
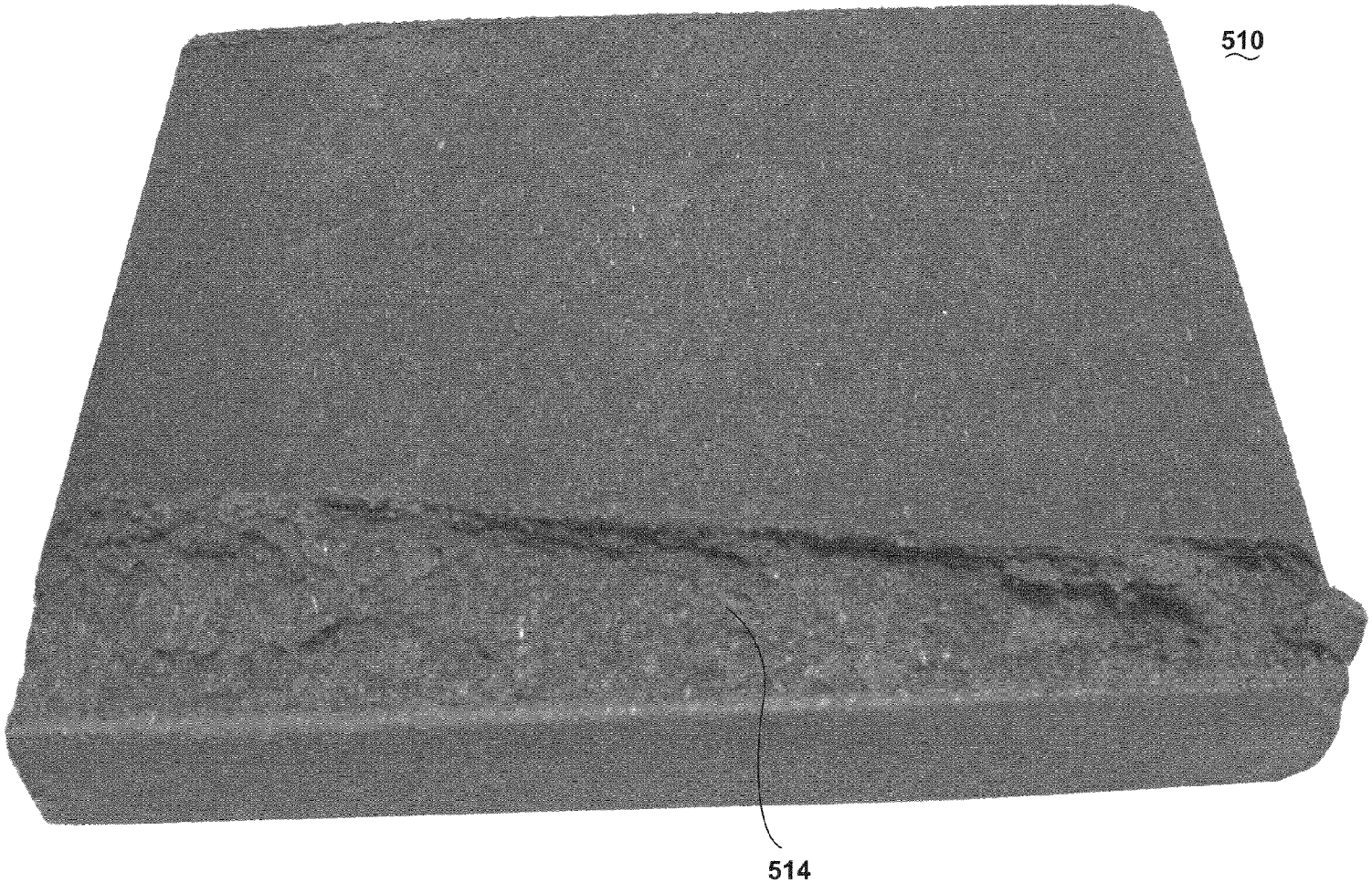

FIGS. 9A-B and 10A-B illustrate photographs of commercially available composite boards which are formed by extruding filled polymer composites that do not include an oriented polymer composite material. FIGS. 9A-B illustrate an example of a board 500 and 502 formed from an extruded polymeric composite comprising polyvinylchloride and a cellulosic filler that was moved against a 24 degree angle splitting wedge (FIG. 9A) and a 70 degree angle splitting wedge (FIG. 9B), respectively, revealing an interior surface 504 and 506. This type of board can be purchased commercially from Azek® Building Products, Scranton, Pa., U.S.A. FIGS. 10A-10B illustrate an example of a board 508 and 510 formed from an extruded polymeric composite comprising polyethylene and a wood flour filler that was moved against a 24 degree angle splitting wedge (FIG. 10A) and a 70 degree angle splitting wedge (FIG. 10B), respectively, revealing an interior surface 512 and 514. This type of board can be purchased commercially Trex®, Winchester, Va., U.S.A.

As can be seen for both types of composite boards 500, 502 and 508, 510, regardless of which splitting wedge angle is used, the boards 500, 502, 508, and 510 do not split along a single splitting plane along the length of the board, but rather crack and fracture, revealing a course, uneven interior surface 504, 506, 512 and 514, respectively. In addition, the interior surface 504, 506, 512 and 514 that is exposed by the splitting wedge does not have random and non-uniform areas of fibrils of varying dimensions and indications of tear-out. While there is some orientation of the filler particles due to the extrusion process, the polymer chains of the polymeric material forming the board are not sufficiently oriented so as to provide fibrils which can be split and torn out to provide the three-dimensional fibrous surface characteristics representative of real split wood.

Figure 11A:
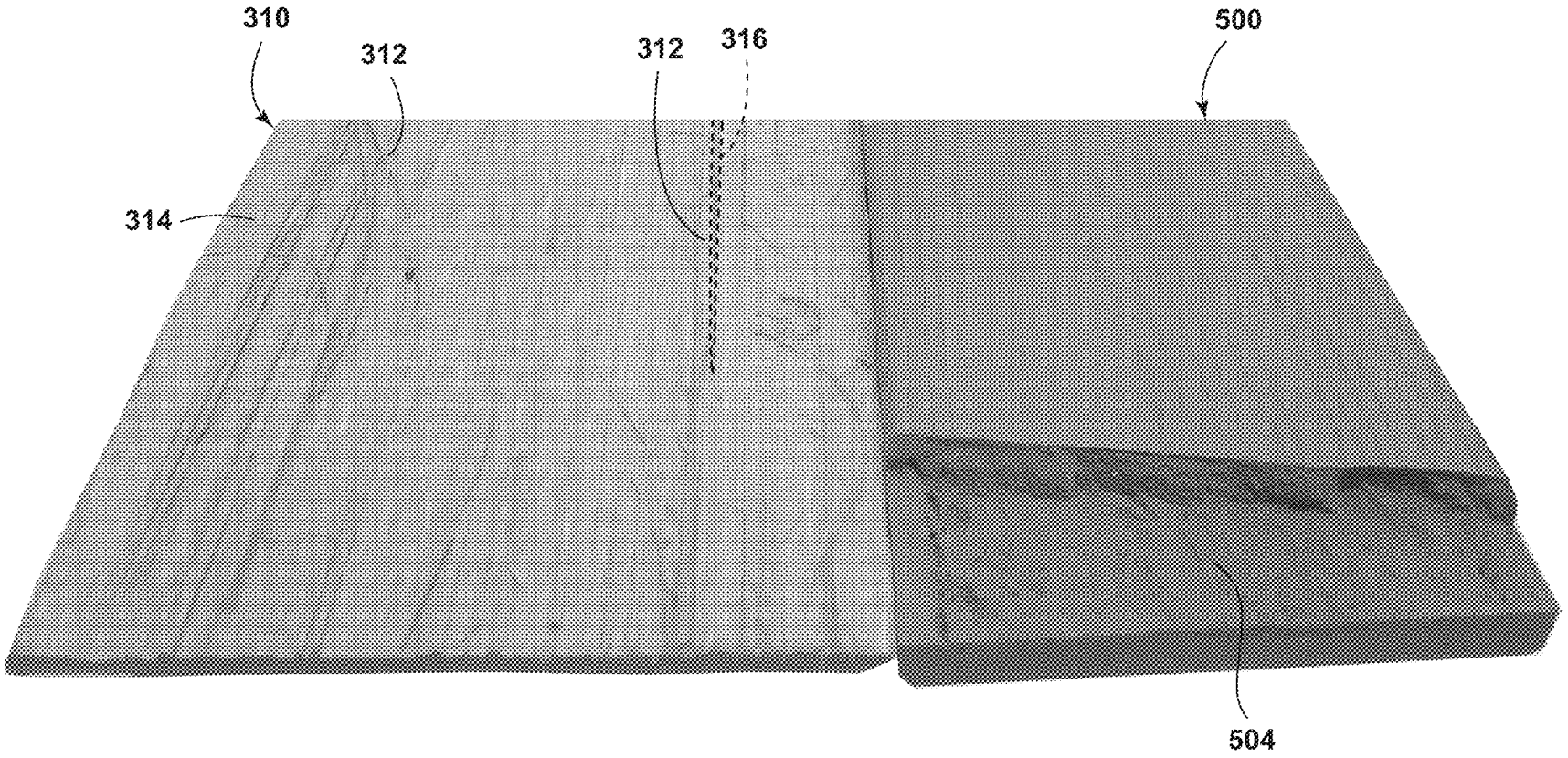
FIG. 11A is a photograph of the split surface of an oriented building product according to an embodiment of the invention illustrated in FIG. 5B and the commercially available composite board of FIG. 9A.
Figure 11B:
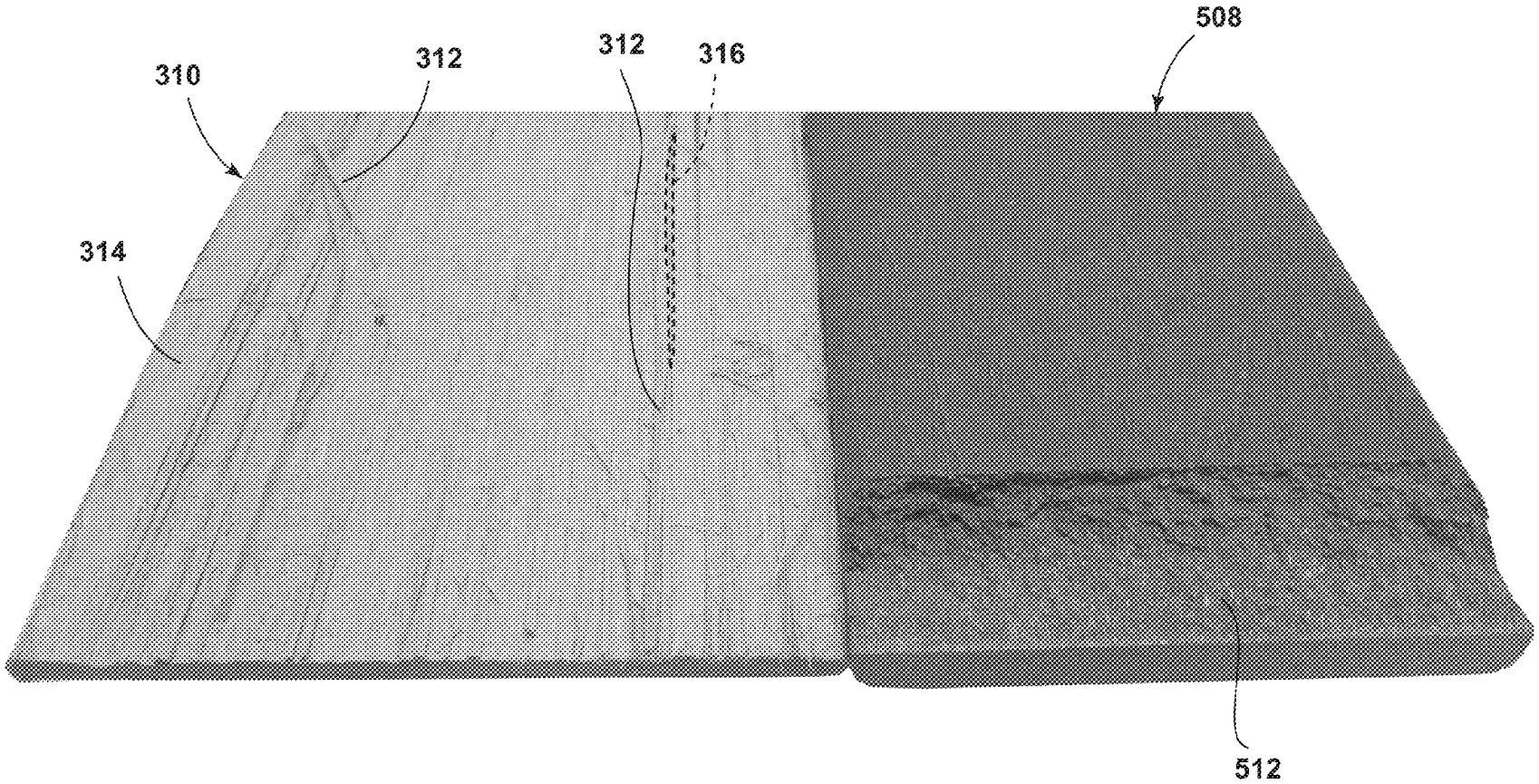
FIG. 11B is a photograph of the split surface of an oriented building product according to an embodiment of the invention illustrated in FIG. 5B and the commercially available composite board of FIG. 10A.

FIGS. 11A and 11B are a side-by-side comparison of the OPC article of FIG. 5B and the unoriented polymeric composite article of FIGS. 9A and 10A, respectively, illustrating the differences in the effect of moving each board against a splitting wedge. As can be seen in FIGS. 11A and 11B, the OPC article of FIG. 5B can be split along a single plane along the length of the board 310 whereas the unoriented polymeric composite article of FIGS. 9A and 10A do not split along a single plane, but rather almost immediately begin to fracture along multiple planes within the depth of the board and ultimately a section of the board breaks off. In addition, the surface characteristics of the OPC article and unoriented polymeric composite article exposed by the splitting wedge are strikingly different. The OPC article exhibits a plurality of fibrils 312 of varying dimensions over the entire length of the article as well as multiple tear-out regions 314 representative of the surface characteristics of real split wood. The unoriented polymeric composite article in contrast, does not resemble the surface characteristics of real split wood and instead shows an uneven solid polymeric surface 504 and 512 interspersed with filler particulates.

The processes and compositions described herein can be used to provide boards made from oriented polymer compositions OPC which have a visual appearance that mimics or simulates the appearance of rough split wood. The OPC split boards described herein can have split surfaces that contain multiple visible fibrils across the width and length of the board as well as a three dimensional contour. The three dimensional contour can be provided by random and non-uniform areas of fibrils of varying dimensions and indications of "tear-out" or gouges, which leave high and low spots in the split surface, all of which contribute to providing the split OPC surface with an appearance similar to that of split wood.

When sawn into planks and split, wood shakes have substantial variability in their surface texture, which variability can be large or small depending on the wood. Neither molded, pressed nor extruded composite materials are able to provide the three dimensional texture and variability that real wood is capable of producing when split. Molded and pressed products are often designed to mimic a wood grain appearance, but have an inherent repeating pattern that comes from the manufacturing tools (it would be too expensive to have mold and press tooling that was truly random and non-repeating in the wood grain embossments it forms), which further detracts from the authentic appearance compared to wood shakes. In addition, the injection molded polymer shakes cannot be installed in the same manner as wood shakes and the use of battens is often recommended.

Extruded wood plastic composites, such as those used in commercial deck boards, which are typically wood flour filled polyethylene extruded to form the deck boards (an example of which is illustrated in FIGS. 10A and 10B above), do not exhibit a wood-split surface texture when split, but rather exhibit brittle failure of the board in the cross-machine direction at the tip of the splitting wedge, and reveal an uneven solid polymeric surface, interspersed with filler particulates. Thus, not only do the spilt surfaces of the extruded composite boards fail to have a fibrous texture similar to split wood, the boards do not consistently split along a single plane, but rather arbitrarily fracture early in the splitting process.

The embodiments of the invention described herein provide a substitute "wood-like" product that provides the desirable wood-like appearance and rustic split fibrous texture of real wood with substantial variability in surface texture when it is split. In addition, the OPC articles described herein can be installed using the same techniques used for wood products. The OPC articles can also be manufactured at less than the cost of real wood shake products and also have decreased susceptibility to splitting and rotting when compared with natural wood shakes. The oriented polymer composition (OPC) board work piece, with its drawn, long chain polymer structure, has the advantage, when rough split, of providing an exterior surface with a true split-wood shake rustic appearance and feel, and particularly the long fibrous texture normally associated only with natural split wood shakes. By splitting the material (as opposed to molding or pressing a pattern into the surface), a true non-uniform, non-repeating surface characteristic is achieved, very similar to that of split wood grain.

The articles of the invention described herein further have an advantage over natural wood shakes of being resistant to separating, even when nailed close to the ends and even without provision of pilot nail holes, and further resistant to splitting or breaking when flexed or impacted (e.g. sharp blow of a hammer, foot traffic, hail, falling branches, hurricane debris, etc.) due to the integrity of the drawn long strand polymer chain structure of the material. When the articles do not contain cellulose (including no cellulose fillers), a further advantage is the article's resistance to absorbing moisture. Thus, the article is less likely to rot, warp or mildew as a result of prolonged exposure to moisture, and it is further self-protected against insect damage (e.g., termites). Even if cellulose material is present as a filler material, the base structure of the material is polymeric and thus the product is still not prone to structural rotting.

The articles of the invention described herein can be produced using fillers and pigments to produce an article with consistent color through the entirety of the material, but has the further advantage of being paintable and stainable. Thus the coloring of the product can be altered by the manufacturer or consumer as desired. Moreover, the polymer material can be pre-colored during manufacturing to reveal a single color or multicolored (e.g., variegated) rough split surface that may, for example, have the appearance of weathered wood at the time of purchase.

Processing parameters can also be adjusted to alter the characteristics of the split surface of the product. Exemplary, process parameters which can affect the splitting include a) the wedge angle, b) the linear draw ratio of the work piece provided to the wedge, c) the density of the work piece as a result of the incorporation of foaming agent and d) the completeness of the compounding of the materials used to fabricate the billet and the subsequent work piece. Split surface characteristics affected by these parameters include the appearance of fibers and bundles of fibers (strands), interchangeably referred to herein as fibrils, and the appearance and amount of tear-out and changes in the split surface as a result of further surface finishing steps.

The material composition includes fillers such as calcium carbonate or talc and may include a foaming agent. While not wishing to be bound by theory, it is believed that the number and size of crack propagation sites which lead to the surface characteristics observed on splitting of the OPC work piece is dependent on the amount of foaming agent and on the manner of compounding or blending of the filler into the thermoplastic. The amount and physical properties of the additives can also affect the outcome of the split surface appearance by introducing weak points, lines or planes that can alter the way in which the material splits. For example, when splitting under similar conditions a talc filled OPC work piece or a magnesium hydroxide work piece can have different surface appearance.

Other processing factors such as splitting temperature and speed may also affect the split surface characteristics. Applicants have discovered that the factors discussed above-degree of compounding, type of additives, amount of additives, type and blend of polymer, splitting temperature, wedge geometry, and splitting rate, etc.—may be employed to control the appearance of the split surface to achieve the desired appearance for a particular application.

Another advantage is that the rough split surface may be subsequently further treated by additional steps to improve or alter the end appearance. Split boards, because of the oriented nature of the OPC product, have split surfaces which have a visual appearance similar to that of rough split wood; that is, the surface contains a plurality of visible fibrous strands or fibrils across the width and throughout the length of the article; the surface has a three dimensional contour (random and non-uniform areas in which fibrils are of varying dimensions, both length and thickness, and with indications of "tear-out" or gouges, leaving a low or high spot in the surface), similar to the results obtained from splitting the grain structure of wood. For example, the split surface of an OPC article with split surfaces containing relatively fuzzy, lifted fibers can be further processed following splitting by, for example, sanding and/or brushing and/or flame treating the surface to loosen and expose some or all of such loose or long fibers and to reduce their degree of detachment to control the resultant texture and achieve the desired appearance while maintaining the rough split exposed fiber "wood" look to the outer surface. A further advantage of this treatment can be the reduction on the split surface of indications of gouges (tear-out) as a result of melt back of fibrils during the flame treatment which tends to reduce the dimensions of any areas of tear-out and can impart a natural streaked appearance to the surface. The rough split surface may also be painted in a manner similar to that of real wood shakes.

Further advantages may include the provision of mildew-resistant and/or fire retardant additives that can enhance the longevity and versatility of the product as compared to natural wood or the other known substitutes.

The article of the invention may be used in any application for which natural wood shakes or synthetic shakes are currently used. The OPC article work piece can be split in the thickness direction to produce two shakes of equal thickness or the work piece can be split non-uniformly to produce thin and thick shake sections or a work piece or split piece can be split to produce two tapered shakes which are thicker at one end and thinner at the opposite end. The shakes may also be split in the length direction to give products of varying widths. Roofing products and wall coverings are two common applications. The inventive article may be used to form panels, which are then used as roof or wall coverings. The article may be fastened in a similar manner as is known in the art for wood products.

The following clauses define aspects of the embodiments of the invention which are not claimed but are encompassed by the present disclosure.

1. A building product comprising:
   - a polymer composition having a softening temperature that is drawn through a drawing die at a drawing temperature less than the softening temperature of the polymer composition, the polymer composition exiting the drawing die in an axial, lengthwise orientation, to form an oriented polymer composition comprising long chain polymer strands that are aligned lengthwise with the drawn oriented polymer composition, moving the oriented polymer composition against a splitting assembly to separate the oriented polymer composition lengthwise along a longitudinal axis of the oriented polymer composition into at least two planar portions, each planar portion comprising a split face where the oriented polymer composition is split, and splitting a plurality of the long chain polymer strands to produce a building product having:
   - a plurality of oriented polymer composition fibrils extending from the split face of at least one of the planar portions substantially on the entire split face of the at least one planar portion providing an aesthetic representative of a real wood split surface; and
   - a density corrected flexural modulus greater than 2.4 GPa.
2. The building product of 1 wherein each planar portion comprises an outer surface juxtaposed with the split face, the second outer surface comprising a de-oriented surface layer.
3. The building product of 1 wherein the building product length is 12 inches to 48 inches (30.5 cm to 121.9 cm), the width is 2 to 12 inches (5.1 cm to 30.5 cm), and the thickness is ⅛ inch to 2 inches (0.32 cm to 5.1 cm).
4. The building product of 1 wherein the oriented polymer composition comprises an inorganic filler selected from magnesium hydroxide, talc or calcium carbonate.
5. The building product of 4 wherein the oriented polymer composition comprises polypropylene.
6. The building product of 1 having a density of 0.5-1.0 g/cc.

7. The building product of 1 wherein the building product is configured to be overlaid with multiple building products to form an exterior surface of at least one of a roof or a wall.
8. The building product of 1 wherein the oriented polymer composition is a cavitated oriented polymer composition.
9. The building product of 1 wherein the oriented polymer composition further comprises a foaming agent.
10. The building product of 1 wherein the oriented polymer composition comprises long chain polymer strands having a predetermined degree of orientation such that when the oriented polymer composition is split lengthwise into the at least two planar portions, the long chain polymer strands are one of cut by the splitting to form the plurality of oriented polymer composition fibrils or lifted off the split face of at least one of the planar portions.
11. The building product of 1 wherein the moving step occurs one of downstream of the splitter assembly by a pulling device or upstream of the splitter assembly by a pushing device.
12. The building product of 1 wherein the splitting assembly comprises a wedge.
13. The building product of 12 and further comprising providing the wedge with a predetermined wedge angle to alter at least one characteristic of the fibrils formed on the surface of the oriented polymer composition during the splitting step.
14. The building product of 12 wherein a wedge angle of the wedge is at 70 degrees or less and greater than 20 degrees.
15. The building product of 1 and further comprising a locating device adapted to alter at least one of the position of the oriented polymer composition with respect to the splitting assembly, the impingement angle of the oriented polymer composition with respect to the splitting assembly, or both.
16. The building product of 1 and further comprising the step of one of at least partially compounding or pre-compounding a volume of inorganic filler with the polymer composition.
17. The building product of 1 and further comprising the step of forming a plurality of concentrated filler volumes within the oriented polymer composition to form crack propagation sites within the oriented polymer composition.
18. The building product of 1 wherein the step of drawing the oriented polymer composition through the drawing die is at a linear draw ratio greater than 4.
19. The building product of 1 and further comprising separating the drawn oriented polymer composition into discrete portions prior to the step of splitting.
20. The building product of 1 wherein the splitting temperature is at least 25° C. below the softening temperature of the oriented polymer composition.
21. The building product of 1, wherein the splitting further comprises lifting a plurality of the long chain polymer strands from the split face of each planar portion.
22. The building product of 1, further comprising cooling the drawn oriented polymer composition to a splitting temperature less than a softening temperature of the oriented polymer composition prior to the splitting step.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly disclosed.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A building product comprising a body having a length and width both greater than a thickness thereof, the body having a first outer surface bordered by the body length and width, and having a first surface area, and a second outer surface bordered by the body length and width, juxtaposed with the first outer surface thereof, and having a second surface area, and having an interior volume, the building product comprising:

an oriented polymer composition forming the body comprising long chain polymer strands that are aligned with the length of the body, wherein the interior volume of the body is separated along a longitudinal axis thereof to form a first interior split surface juxtaposed with the first outer surface and a second interior split surface juxtaposed with the second outer surface; and a plurality of the long chain polymer strands having terminal portions that extend from the first and second interior split surfaces to form oriented polymer composition fibrils thereon;

wherein the oriented polymer composition fibrils extending from the first and second interior split surfaces provide an aesthetic representative of a real wood split surface.

2. The building product of claim 1 wherein the second outer surface comprises a de-oriented surface layer.

3. The building product of claim 1 wherein the body length is 12 inches to 48 inches (30.5 cm to 121.9 cm), the width is 2 to 12 inches (5.1 cm to 30.5 cm), and the thickness is ⅛ inch to 2 inches (0.32 cm to 5.1 cm).

4. The building product of claim 1 wherein the oriented polymer composition comprises an inorganic filler selected from magnesium hydroxide, talc or calcium carbonate.

5. The building product of claim 4 wherein the oriented polymer composition comprises polypropylene.

6. The building product of claim 1 having a density corrected flexural modulus greater than 2.4 GPa and a density of 0.5-1.0 g/cc.

7. The building product of claim 1 wherein the building product is configured to be overlaid with multiple building products to form an exterior surface of at least one of a roof or a wall.

8. The building product of claim 1 wherein the oriented polymer composition is a cavitated oriented polymer composition.

9. The building product of claim 1 wherein the oriented polymer composition further comprises a foaming agent.

10. The building product of claim 1 wherein the oriented polymer composition comprises long chain polymer strands having a predetermined degree of orientation, wherein the split body comprises long chain polymer strands that are one of cut by the splitting to form the plurality of oriented polymer composition fibrils or lifted off the at least one of the first or second outer surface.

11. The building product of claim 1 wherein at least one of the first or second outer surfaces is heat treated.

12. A method for manufacturing a building product comprising the steps of:

providing a polymer composition having a softening temperature;

drawing the polymer composition through a drawing die at a drawing temperature less than the softening temperature of the polymer composition, the polymer composition exiting the drawing die in an axial, lengthwise orientation, to form an oriented polymer composition comprising long chain polymer strands that are aligned lengthwise with the drawn oriented polymer composition;

moving the oriented polymer composition against a splitting assembly to separate the oriented polymer composition lengthwise along a longitudinal axis of the oriented polymer composition into at least two planar portions, each planar portion comprising a split face where the oriented polymer composition is split; and splitting a plurality of the long chain polymer strands to form a plurality of long chain polymer strands having terminal portions that extend from the split face of each planar portion on substantially the entire split face of each planar portion to form oriented polymer composition fibrils thereon;

wherein the oriented polymer composition fibrils extending from the split face of each planar portion provide an aesthetic representative of a real wood split surface.

13. The method of claim 12 wherein the moving step occurs one of downstream of the splitter assembly by a pulling device or upstream of the splitter assembly by a pushing device.

14. The method of claim 12 wherein the splitting assembly comprises a wedge.

15. The method of claim 14 and further comprising providing the wedge with a predetermined wedge angle to alter at least one characteristic of the fibrils formed on the surface of the oriented polymer composition during the splitting step.

16. The method of claim 14 wherein a wedge angle of the wedge is 70 degrees or less and greater than 20 degrees.

17. The method of claim 12 and further comprising a locating device adapted to alter at least one of a position of the oriented polymer composition with respect to the splitting assembly, an impingement angle of the oriented polymer composition with respect to the splitting assembly, or both.

18. The method of claim 12 and further comprising the step of one of at least partially compounding or pre-compounding a volume of inorganic filler with the polymer composition.

19. The method of claim 12 and further comprising the step of forming a plurality of concentrated filler volumes within the oriented polymer composition to form crack propagation sites within the oriented polymer composition.

20. The method of claim 12 wherein the step of drawing the oriented polymer composition through the drawing die is at a linear draw ratio greater than 4.

21. The method of claim 12 and further comprising separating the drawn oriented polymer composition into discrete portions prior to the step of splitting.

22. The method of claim 12 wherein a splitting temperature is at least 25° C. below the softening temperature of the oriented polymer composition.

23. The method of claim 12, wherein the splitting further comprises lifting a plurality of the long chain polymer strands from the split face of each planar portion.

24. The method of claim 12, further comprising cooling the drawn oriented polymer composition to a splitting temperature less than a softening temperature of the oriented polymer composition prior to the splitting step.

25. The method of claim 12, further comprising heat treating the split face of at least one of the planar portions after the splitting step.

* * * * *